US011278785B1

(12) United States Patent
Wiesolek

(10) Patent No.: US 11,278,785 B1
(45) Date of Patent: Mar. 22, 2022

(54) BASKETBALL RETURN BACKSTOP NET WITH ANGULAR ADJUSTABILITY

(71) Applicant: Rukket, LLC, Wilmington, DE (US)

(72) Inventor: Jarrett J. Wiesolek, Cedarburg, WI (US)

(73) Assignee: Rukket, LLC, Wilmington, DE (US)

( * ) Notice: Subject to any disclaimer, the term of this patent is extended or adjusted under 35 U.S.C. 154(b) by 0 days.

(21) Appl. No.: 17/084,789

(22) Filed: Oct. 30, 2020

Related U.S. Application Data

(63) Continuation-in-part of application No. 16/674,664, filed on Nov. 5, 2019, now Pat. No. 10,994,186.

(60) Provisional application No. 62/774,530, filed on Dec. 3, 2018.

(51) Int. Cl.

| | |
|---|---|
| ***A63B 69/00*** | (2006.01) |
| ***A63B 71/02*** | (2006.01) |
| ***A63B 63/08*** | (2006.01) |
| *A63B 63/00* | (2006.01) |

(52) U.S. Cl.
CPC ..... *A63B 71/022* (2013.01); *A63B 63/083* (2013.01); *A63B 69/0071* (2013.01); *A63B 71/028* (2013.01); *A63B 2063/001* (2013.01)

(58) Field of Classification Search
CPC . A63B 63/083; A63B 69/0071; A63B 71/028; A63B 2063/001; A63B 69/022
USPC ..... 473/433, 431, 432, 434, 435, 447, 422, 473/473–476, 197; 273/394–397
See application file for complete search history.

(56) References Cited

U.S. PATENT DOCUMENTS

| | | | |
|---|---|---|---|
| 3,195,898 | A | 7/1965 | Respini |
| 3,901,506 | A | 8/1975 | Caveney |
| 4,045,032 | A | 8/1977 | Cox |
| 4,880,239 | A | 11/1989 | Leneveu |
| 5,129,648 | A | 7/1992 | Sweeney et al. |
| 5,273,275 | A | 12/1993 | Wilkerson |
| 5,312,099 | A | 5/1994 | Oliver, Sr. |
| 5,368,292 | A | 11/1994 | Metz |
| 5,402,999 | A | 4/1995 | Keehn, Sr. |
| 5,409,211 | A | 4/1995 | Adamek |
| 5,746,668 | A | 5/1998 | Ochs |
| 5,971,873 | A | 10/1999 | Balducci |
| 6,056,652 | A | 5/2000 | Lees et al. |
| 6,074,313 | A | 6/2000 | Pearson |
| 6,416,431 | B1 | 7/2002 | Keehn, Sr. et al. |

(Continued)

OTHER PUBLICATIONS

SKLZ D-Man A Trainer Defense Mannequin.

*Primary Examiner* — Mitra Aryanpour
(74) *Attorney, Agent, or Firm* — Rogowski Law LLC

(57) ABSTRACT

A freestanding basketball backstop assembly returns basketballs shot at a basketball hoop to a player positioned at a location spaced apart from the basketball hoop. A net support has a base and side legs, with vertical rods removably insertable into sockets of the side legs and threaded through sleeves extending from the side edges of the net peripheral border. The base is placed in front of the post supporting the basketball backboard. In one embodiment, the net is arranged behind the post supporting the backboard, and a slit opening in the bottom periphery of the net receives a portion of the post supporting the backboard. In other embodiments, the net remains in front of the post supporting the backboard, and the vertical rods are set variably to place the net in different angle orientations so that the assembly may be used either as a backstop assembly, or as a defender barrier in front of the basketball basket or as a barrier or practice net for other sports.

17 Claims, 15 Drawing Sheets

(56) References Cited

U.S. PATENT DOCUMENTS

| | | | |
|---|---|---|---|
| 6,595,877 | B2 | 7/2003 | Pearson |
| 6,733,403 | B2 | 5/2004 | Courtright |
| 6,746,348 | B2 | 6/2004 | Barnes et al. |
| 6,761,649 | B1 | 7/2004 | Medley, Jr. |
| 7,244,199 | B1 | 7/2007 | Romano |
| 7,510,492 | B2 | 3/2009 | Hudson |
| 7,530,909 | B2 | 5/2009 | Thomas et al. |
| 8,206,246 | B2 | 6/2012 | Joseph et al. |
| 8,460,129 | B2 | 6/2013 | Forlini et al. |
| 8,845,460 | B1 | 9/2014 | Feldstein |
| 8,852,030 | B2 | 10/2014 | Campbell et al. |
| 8,876,637 | B2 | 11/2014 | Atkins |
| 9,289,663 | B1 | 3/2016 | Bollinger |
| 9,717,973 | B2 | 8/2017 | Elpers et al. |
| 9,931,555 | B1 | 4/2018 | McCoy |
| 10,124,233 | B2 | 11/2018 | Nelson |
| 10,576,353 | B2 | 3/2020 | Givens |
| 2009/0137347 | A1 | 5/2009 | Jenkins et al. |
| 2010/0160093 | A1 | 6/2010 | MacArthur |
| 2013/0331208 | A1 | 12/2013 | Elpers |

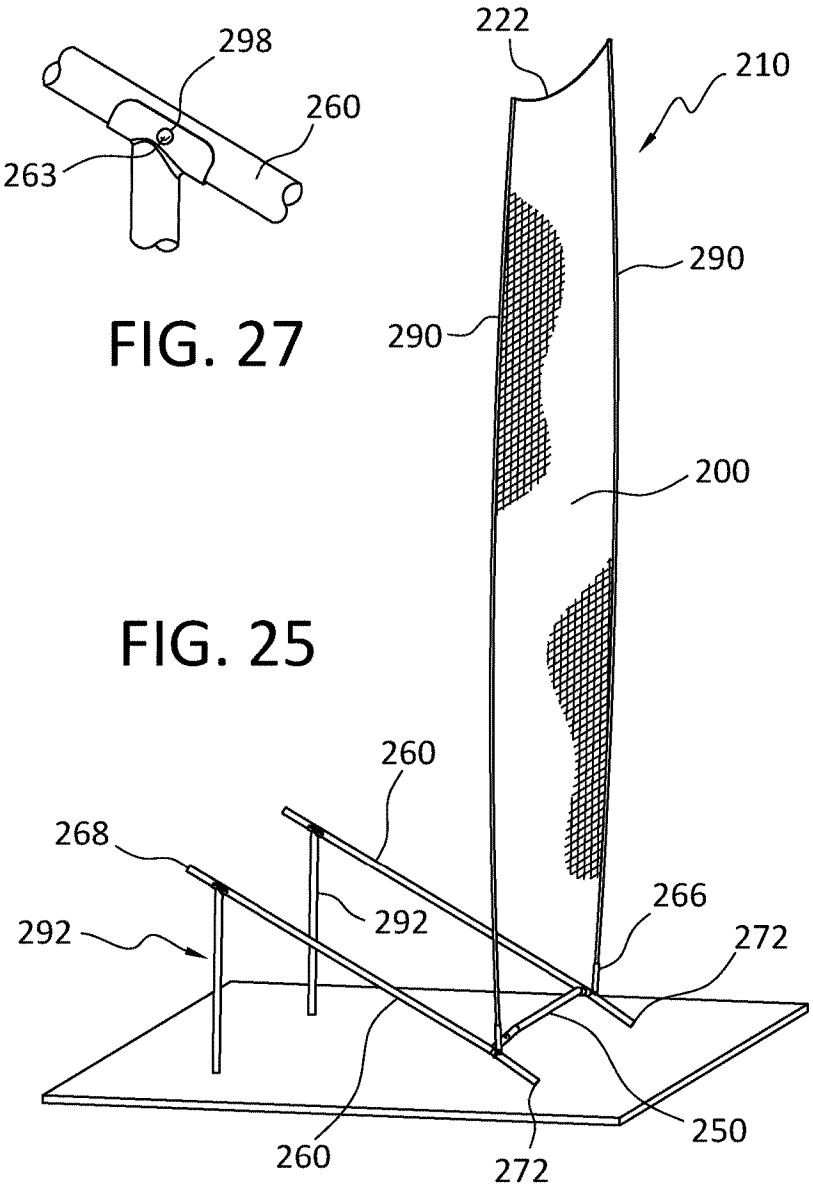
FIG. 25
FIG. 27
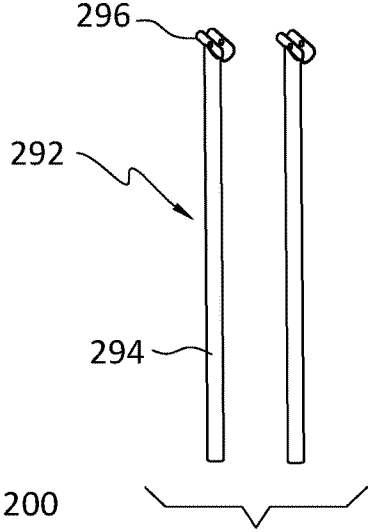
FIG. 26
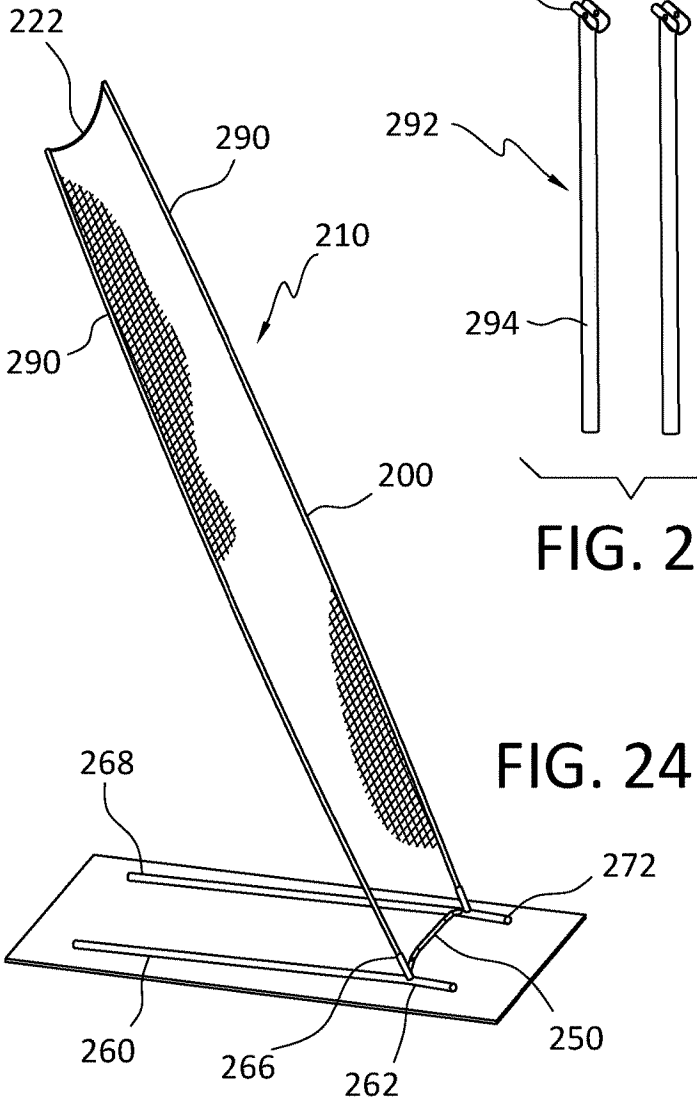
FIG. 24

410
490
420
460
466
472
422
450
472
490
466
465
460
496
494
494
460
496
460
494

468
494

496
492
494
410
490
422
490
420
450
472
462
460
468

BASKETBALL RETURN BACKSTOP NET WITH ANGULAR ADJUSTABILITY

CROSS-REFERENCE TO RELATED APPLICATIONS

This application claims priority under 35 USC 120 to U.S. Utility application Ser. No. 16/674,664, entitled "Basketball Return Backstop Net Assembly", filed Nov. 5, 2019, which application claims 35 USC § 119(e) to U.S. Provisional Application Ser. No. 62/774,530, entitled "Basketball Return Backstop Net Assembly", filed Dec. 3, 2018, the disclosures of each of which are incorporated by reference herein.

FIELD OF THE INVENTION

The present invention is generally directed to a freestanding basketball return backstop net assembly for use with a basketball hoop and backboard mounted to a vertical post with angular adjustment to convert the backstop net assembly to a defensive barrier for basketball or a practice barrier for volleyball.

BACKGROUND OF THE INVENTION

Basketball players often practice free throws and other shots by tossing a basketball toward the basketball goal or hoop while spaced apart from the goal or hoop. If the players are practicing alone, the player must chase after a rebound for a ball that misses the goal or hoop or must approach the goal or hoop to retrieve a ball after a successful shot into the goal or hoop. Some playground basketball goals are mounted on posts that do not have a gym wall or other wall structure behind the post and backboard. In these cases, errant balls may travel far behind the post and backboard. There is a need for apparatus to return the ball to the player at the player's shooting position.

Basketball retrieval apparatus are known for returning basketballs from behind a basketball backboard. Many of these structures attach nets or screens to the backboard and/or to the vertical post holding the backboard and basketball net. U.S. Pat. No. 7,530,909, for example, shows a basketball return net mounting system that attaches mounting brackets to a rear of a basketball backboard. A net structure is then suspended downwardly from the mounting brackets and under the basket. U.S. Pat. No. 5,971,873, as another example, shows a backstop screen for a basketball net that is attached to mounting structures appended to the top and bottom of the vertical post holding the backboard and the basketball net. U.S. Pat. No. 8,460,129 shows a backstop retrieving device comprising a net that is coupled to clamps that are in turn connected to the top of the backboard. Weights are joined to the bottom of the net.

U.S. Pat. No. 6,595,877 shows a basketball return net assembly with an adjustment bracket. However, the adjustment mechanism is connected to the post supporting the basketball hoop backboard. The assembly is not freestanding and does not convert from a backstop return net to a defensive barrier.

Basketball players do not always have freedom to connect a backstop or net to the backboard or post of a basketball goal. A freestanding backstop that is quickly assembled and installed, and quickly disassembled, would have advantages over prior retrieval apparatus that must be connected to the backboard or vertical post. A freestanding backstop that converts from one angular orientation to be used for rebounding or returning a basketball to another angular orientation to be used as a defensive barrier also would have advantages over prior retrieval apparatus. Moreover, the defensive barrier also may be adapted for other sports use, such as a practice barrier for volleyball.

BRIEF SUMMARY OF THE INVENTION

In a first aspect, the invention comprises a basketball backstop assembly to return basketballs shot at a basketball hoop to a player positioned at a location spaced apart from the basketball hoop is a freestanding structure that does not have supporting connections to the backboard or to the post supporting the backboard and hoop. The basketball backstop assembly includes a base having a first end and a second end and a base length between the first end and the second end. The base may comprise multiple segments that are joined together, and may include a rope or cord threaded through the multiple segments. Such rope or cord may be elastic or stretchy.

The basketball backstop assembly further includes a right side leg and a left side leg. One end of the base is removably joined into a receiving socket in the right side leg and the opposite end of the base is removably joined into a receiving socket in the left side leg. The right side leg has a second socket that is disposed at an angle to the first socket, such as an angle between 90 to 120 degrees. The left side leg has a second socket that is disposed at an angle to the first socket, such as an angle between 90 to 120 degrees.

The basketball backstop assembly may include additional right side leg and left side leg extenders to lengthen the right side leg and the left side leg, as desired.

A right vertical rod is removably attachable to the second receiving socket in the right side leg. A left vertical rod removably attachable to the second receiving socket in the left side leg. In one variant, the right vertical rod is formed from a combination of two or more rod segments threadedly joined together, and the left vertical rod is formed from a combination of two or more rod segments threadedly joined together. Preferably the right vertical rod (or segments thereof) and the left vertical rod (or segments thereof) are formed of fiberglass or other flexible material.

A net having a peripheral border (e.g., having a top, a bottom, a right side and a left side), also defines at least one slit through its bottom peripheral border. The net also has at least one right sleeve associated with its right side and at least one left sleeve associated with its left side. The right vertical rod is threaded or passed through the right sleeve and the left vertical rod is threaded or passed through the left sleeve. In one variant, the net has two or more right sleeves and two or more left sleeves, and the right vertical rod is threaded or passed through the two or more right sleeves and the left vertical rod is threaded or passed through the two or more left sleeves.

In an advantageous embodiment, at least one cord depends from a first bottom corner of the net peripheral border between the right side and the bottom. Such cord is adapted for removably joining to the right side leg. At least a second cord depends from a second corner of the net peripheral border between the left side and the bottom. Such second cord is adapted for removably joining to the left side leg. The first and second cords may be elastic or stretchy, and may have hooks or other fasteners appended at one or both ends.

At least one loop depends from a first top corner of the net peripheral border between the right side and the top. The at least one loop is adapted for removably joining to a top portion of the right vertical rod. At least one other loop depends from a second top corner of the net peripheral border between the left side and the top. The at least one other loop is adapted for removably joining to a top portion of the left vertical rod. The first and second loops may be formed of stretchy cord or roping material, or alternatively of metal wire or chain link.

In one variant, the basketball backstop assembly further includes at least one fastener associated with the slit in the bottom peripheral border of the net. Moreover, the slit may extend from the bottom of the peripheral border to a length of a portion of the net. In addition, or alternatively, a plurality of fasteners may be incorporated onto or near the slit to join a first slit edge to a second slit edge of the slit.

In another variant, stakes may be used to secure the right side leg to a ground surface and the left side leg to a ground surface.

In a second aspect, the invention comprises a method of assembling the basketball backstop assembly for use with a basketball backboard in a freestanding fashion without need for joining the backstop assembly for support to the backboard or to the post supporting the backboard. The method comprises assembling the base and legs together by joining a first end of the base to a first receiving socket of a right side leg, said right side leg having a right side length and defining a first axis along the right side length, with the first receiving socket along the right side length and disposed at a first angle to the first axis. Then, joining the second end of the base to a third receiving socket of a left side leg, said left side leg having a left side length and defining a second axis along the left side length, said left side leg having the third receiving socket along the left side length, with the third receiving socket disposed at a first angle to the second axis.

Next, the method comprises assembling the vertical rods to the base and side legs by joining a right vertical rod to a second receiving socket of the right side leg, said second receiving socket disposed along the right side length at a second angle to the first axis, and by joining a left vertical rod to a fourth receiving socket of the left side leg, said fourth receiving socket disposed along the left side length at a second angle to the second axis.

As a next step, the net is joined to the vertical rods and to the legs. The net has a peripheral border having a top, a bottom, a right side and a left side, and having the at least one right sleeve associated with its right side, and having at least one left sleeve associated with its left side, said net further defining at least one slit through its bottom peripheral border. The right vertical post is threaded or passed through at least one right sleeve of a net, and the left vertical rod is threaded or passed through the at least one left sleeve of the net. In an advantageous embodiment, cords depending from the bottom corners of the net peripheral border are joined to the respective right side leg and left side leg. Loops depending from the top corners of the net peripheral border are joined to the tops of the right vertical rod and left vertical rod.

The basketball backstop assembly is then located so that the top peripheral border of the net is behind the backboard. In a preferred variant, the bottom peripheral border of the net is positioned in front of a post supporting the backboard. More preferably, the slit in the net and net periphery is positioned around the post supporting the backboard. The edges of the slit may be fastened together with at least one fastener provided on the net or on the bottom of the periphery of the net.

The basketball backstop assembly is used without need for fasteners to penetrate the post or into the backboard supported by the post. The basketball backstop assembly is freestanding and has no mountings that must be connected to the post or the backboard supported by the post. The vertical rods create tension in the net due to their flexibility and their positioning with their bottom ends in the sockets of the side legs disposed at angles away from one another.

Alternative configurations of the basketball backstop assembly also may be used without need for fasteners to penetrate the post or into the backboard supported by the post. Such alternative configurations also are freestanding, and have no mountings that must be connected to the post or the backboard supported by the post. Moreover, the alternative configurations have angular adjustability to permit a user to convert the backstop assembly from a rebounding or ball returning orientation to a defensive barrier (or practice net) orientation.

In these alternative configurations, the basketball backstop assembly has a base having a first end and a second end and a base length between the first end and the second end, a right side leg having a right side length and defining a first axis along the right side length, said right side leg directly or indirectly joined to the first end of the base, and a left side leg having a left side length and defining a second axis along the left side length, said left side leg directly or indirectly joined to the second end of the base. A net defines a peripheral border having a top, a bottom, a right side and a left side, said net having at least one right sleeve associated with its right side and at least one left sleeve associated with its left side. A right vertical rod is removably attachable to the right side leg, with a portion of the right vertical rod held in the right sleeve. A left vertical rod is removably attachable to the left side leg, with a portion of the left vertical rod held in the left sleeve. A net angle adjusting means is configured to permit a user to change net orientation (a) from vertical or substantially vertical to at least one other net orientation at an angle different from vertical or substantially vertical, or (b) from the at least one other net orientation at an angle different from vertical or substantially vertical to the net origination of vertical or substantially vertical.

In a second embodiment, the net angle adjusting means comprises a first socket unit associated with the right side leg and a second socket unit associated with the left side leg. The first socket unit has a first socket and a second socket, and the second socket unit has a third socket and a fourth socket. When a bottom portion of the right vertical rod is held in the first socket and a bottom portion of the left vertical rod is held in the third socket, the net is held in the net orientation that is vertical or substantially vertical, and when the bottom portion of the right vertical rod is held in the second socket and the bottom portion of the left vertical rod is held in the fourth socket, the net is held in the at least one other net orientation at an angle different from vertical or substantially vertical.

In a third embodiment, the net angle adjusting means comprises a first flange associated with the right side leg and a second flange associated with the left side leg. The first flange defines a first arcuate slot and the second flange defines a second arcuate slot. A bottom portion of the first vertical rod is joined for rotation to the first flange with range of rotational movement of the first vertical rod relative to the first flange defined by the first arcuate slot. A bottom portion of the second vertical rod is joined for rotation to the second flange with range of rotational movement of the second vertical rod relative to the second flange defined by the second arcuate slot. The angle adjusting means may include a first detent pin extending from the bottom portion of the first vertical rod and a second detent pin extending from the bottom portion of the second vertical rod. With this configuration, the first flange defines at least two holes spaced apart from the first arcuate slot, with each of said holes selectively configured to receive the first detent pin, and the second flange defines at least two other holes spaced apart from the second arcuate slot, with each of said other holes selectively configured to receive the second detent pin. The bottom portions of the first vertical rod and the second vertical rod may be forked, such as in the form of an inverted U, with one fork prong on one side of the respective flange and a second fork prong on an opposite side the respective flange, and with both forks joined to the respective bolt that is held in the arcuate slot of the flange.

In a fourth embodiment, the net angle adjusting means comprises a first riser engagable to the right side leg and a second riser engageable to the left side leg. An exemplary first riser may comprises a post with a channel sleeve configured to receive a portion of the right side leg, and when so received, holds the portion of the right side leg above a support surface. An exemplary second riser may comprise a second post with a second channel configured to receive a portion of the left side leg, and when so received, holds the portion of the left side leg above the support surface. In this exemplary embodiment, when the first riser is engaged to the right side leg and the second riser is engaged to the left side leg, the net orientation is changed from an angle different from vertical or substantially vertical to an angle that is vertical or substantially vertical. A first detent or first spring pin may extend from a sidewall of the right side leg and is configured to engage a hole in the channel sleeve, and a second detent or second spring pin may extend from a sidewall of the left side leg and is configured to engage a hole in the second channel sleeve.

In a fifth embodiment, the first riser comprises a first post with a first top end and the second riser comprises a second post with a second top end. The right side leg defines a hole or recess configured to receive the top end of the first post, and when so received, holds a portion of the right side leg above a support surface. The left side leg defines a second hole or recess configured to receive the second top end of the second post, and when so received, holds a portion of the left side leg above the support surface. When the first riser and second riser are joined to the right side leg and left side leg respectively, net orientation is changed from an angle different from vertical or substantially vertical to an angle that is vertical or substantially vertical.

In a sixth embodiment, the first riser comprises a first leg post with a first post top end and the second riser comprises a second leg post with a second post top end. The first post top end is rotatably joined to the right side leg and the second post top end is rotatably joined to the left side leg. When the first leg post is substantially parallel to the right side leg and the second leg post is substantially parallel to the left side leg, net orientation is at an angle different from vertical or substantially vertical, and when the first leg post is rotated and the second leg post is rotated, a portion of the right side leg and a portion of the left side leg are held above a support surface and the net orientation changes from the angle different from vertical or substantially vertical to an angle that is vertical or substantially vertical.

In a seventh embodiment, the first riser comprises a first post defining an axis along its length, with a first fitting at one end and a second fitting projecting from a sidewall of the first post, with each of the first fitting and the second fitting configured to be received selectively within an opening defined in the right side leg. The second riser comprises a second post defining a second axis along its length, with a third fitting at one end of the second post and with a fourth fitting projecting a sidewall of the second post, with each of the third fitting and the fourth fitting configured to be received selectively within an opening defined in the left side leg. When the first fitting is held in the opening in the right side leg and the third fitting is held in the opening in the left side leg, net orientation is at an angle different from vertical or substantially vertical. When the second fitting is held in the opening in the right side leg and the fourth fitting is held in the opening in the left side leg, a portion of the right side leg and a portion of the left side leg are held above a support surface and the net orientation changes from the angle different from vertical or substantially vertical to an angle that is vertical or substantially vertical. In this seventh embodiment, the first riser may be a right leg extender removably attachable to the right side leg, and the second riser may be a left leg extender removably attachable to the left side leg.

In the alternative configurations, the right vertical rod and the left vertical rod to which the net is joined may be formed of fiberglass or other flexible material, whether a single piece or multiple pieces joined together. The net may have a plurality of left sleeves and a plurality of right sleeves to receive the vertical rods. In addition, stakes may be used to secure the right side leg and the left side legs to a ground surface if the support surface is an outdoor ground surface.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings an embodiment of a freestanding basketball backstop assembly which is presently preferred. It should be understood, however, that the disclosure is not limited to the precise arrangements and instrumentalities shown. In the drawings:

FIG. 24 is a left side perspective view of a backstop assembly according to a third embodiment of the invention in which the net is held at an angle from vertical;

FIG. 25 is a left side perspective view of the backstop assembly of FIG. 24 in which the net is held vertically or substantially vertically;

FIG. 26 is an enlarged perspective view of two back leg support posts;

FIG. 27 is an enlarged perspective view of a back leg held within a channel at the top of one back leg support post;

DESCRIPTION OF THE DISCLOSURE

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 1:
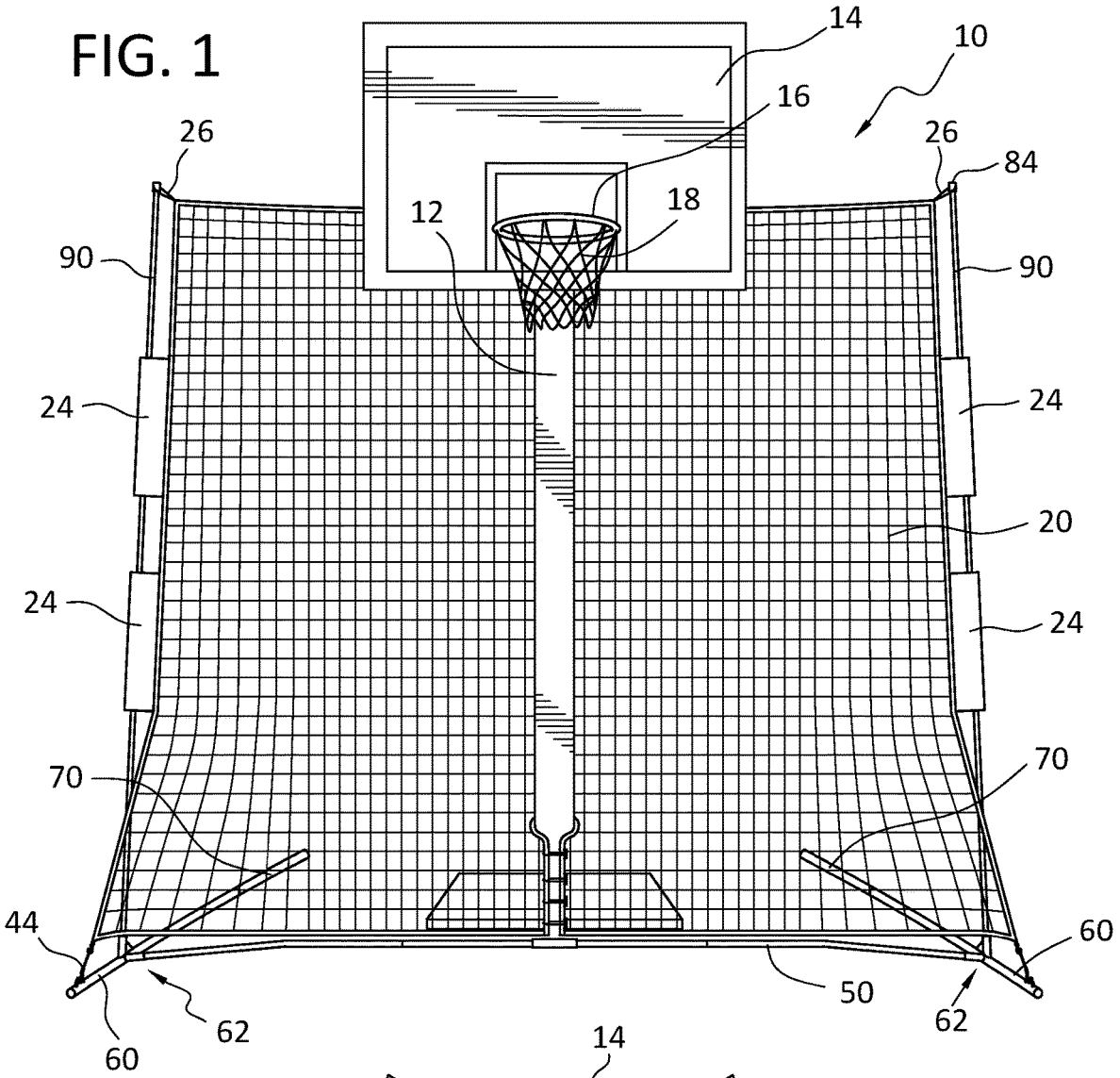
FIG. 1 is a front elevational view of a backstop assembly according to a first embodiment of the invention.
Figure 2:
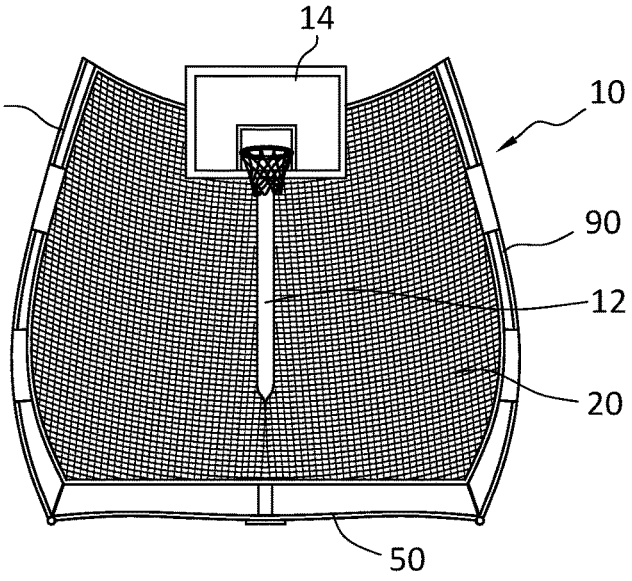
FIG. 2 is an alternative front elevational view of the backstop assembly of FIG. 1.
Figure 3:
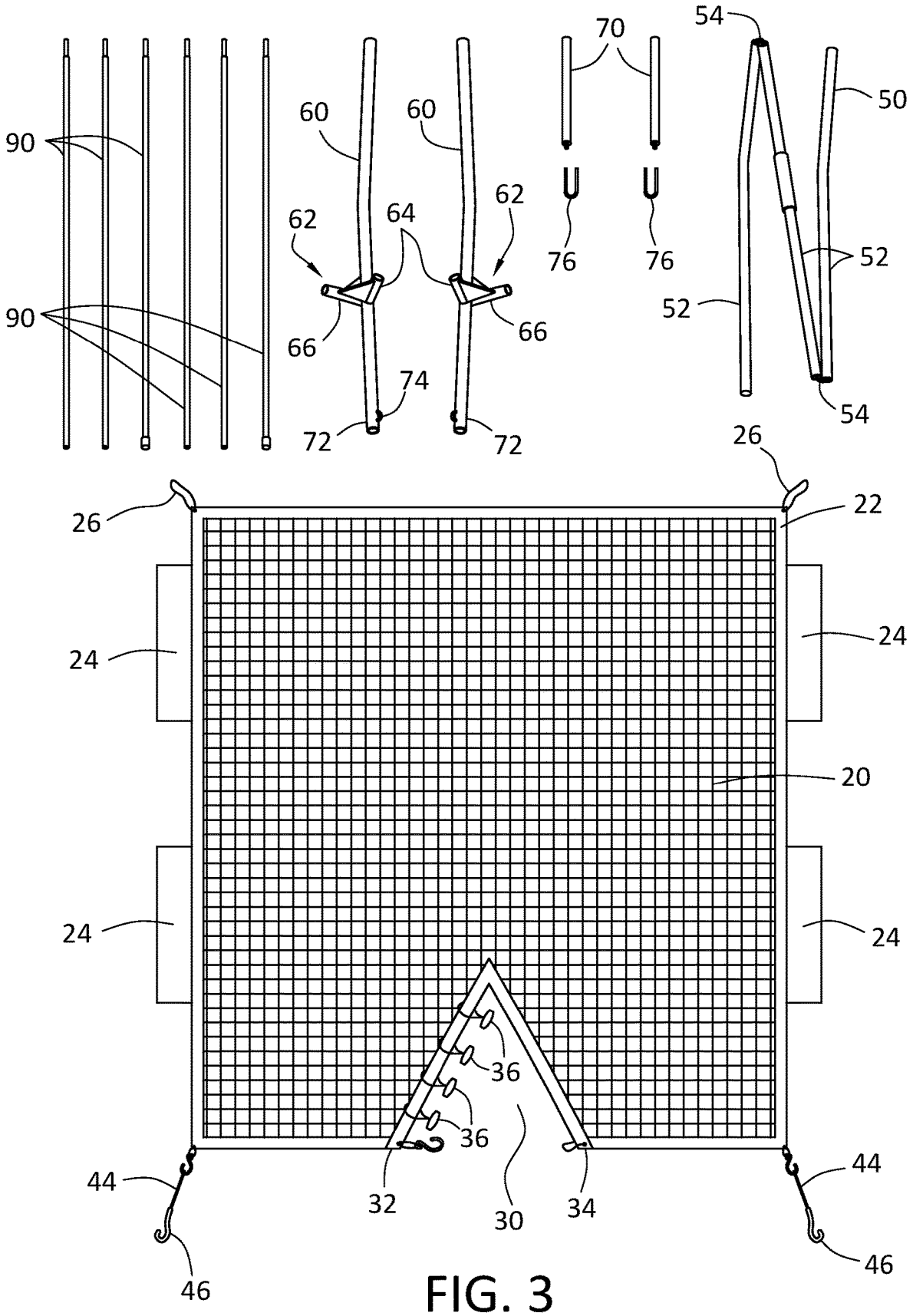
FIG. 3 is a front elevational view of parts for constructing the backstop assembly of FIG. 1.
Figure 16:
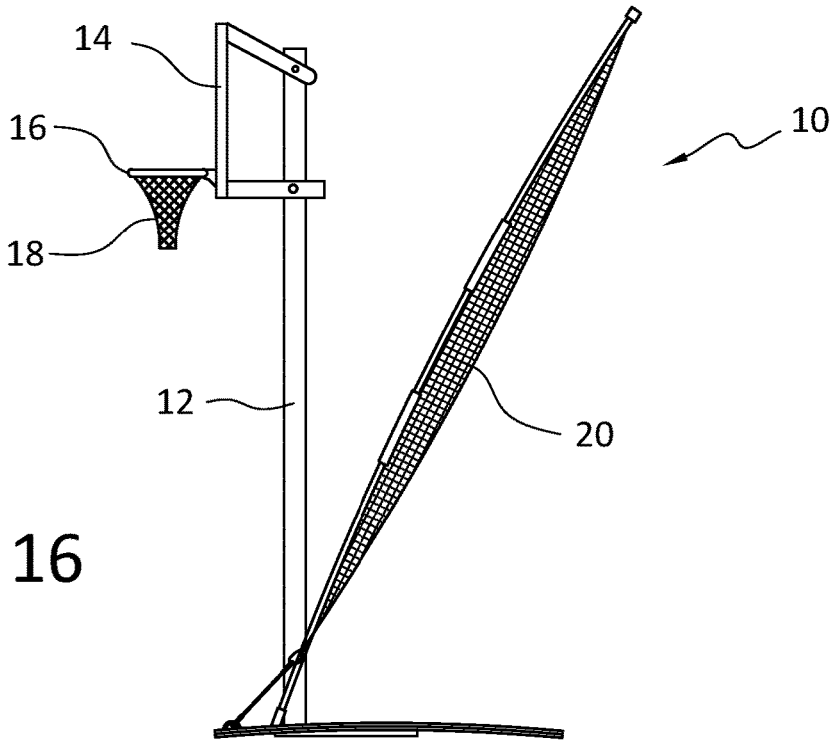
FIG. 16 is a right side elevational view of the backstop assembly of FIG. 1.

Referring to the drawings in detail, FIGS. 1, 2 and 16 show a basketball backstop assembly 10 installed for use with a basketball backboard 14 mounted to a vertical post 12. A hoop 16 to which a basketball net 18 is attached is supported on the backboard 14. The basketball backstop assembly 10 includes a net 20 that is supported by two generally vertically extending rods 90. The rods 90 are supported by a base 50 and side legs 60. The various components to make the basketball backstop assembly 10 are shown in FIG. 3.

Figure 4:
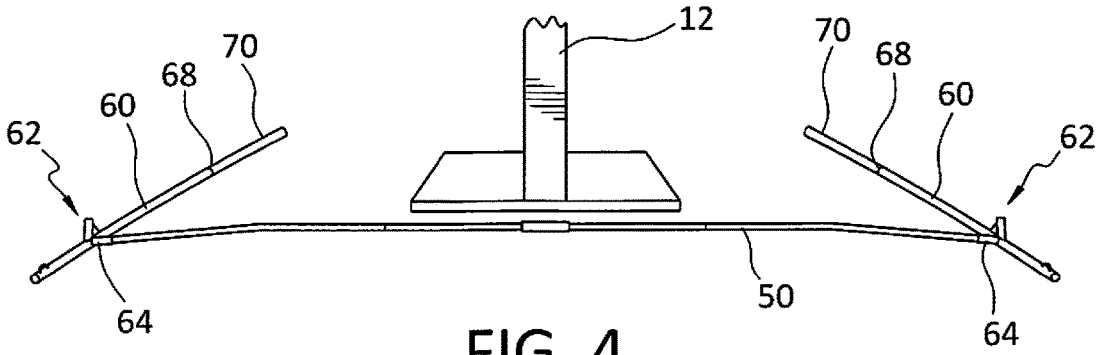
FIG. 4 is a front elevational view of a base of the backstop assembly of FIG. 1.

The steps for assembling the basketball backstop assembly 10 are illustrated in FIGS. 4-15. Referring first to FIG. 4, the base 50 and side legs 60 are joined together. In the embodiment shown, the base 50 comprises separable base bar or tube sections 52 with a cable 54 threaded through the sections 52. The cable 54 is generally stretchy or elastic and may be extended to a length that is longer than the combined lengths of the sections 52 when the sections are disposed in end to end relation. The side legs 60 may be rods or tubes onto which corner socket units 62 are joined or formed. The left side of the base 50 is removably insertable into a socket opening 64 of the left side leg 60, and the right side of the base 50 is removably insertable into a socket opening 64 of the right side leg 60.

The corner socket units 62 shown in FIG. 4 are disposed along the length of the left side leg and right side leg. Each socket opening 64 is directed at an angle away from the axis of the respective side leg. The corner socket units 62 additionally have socket openings 66 disposed at an angle from 90 to 120 degrees from the socket openings 64. The socket openings 66 are adapted to receive vertically extending rods or posts 90.

Figure 6:
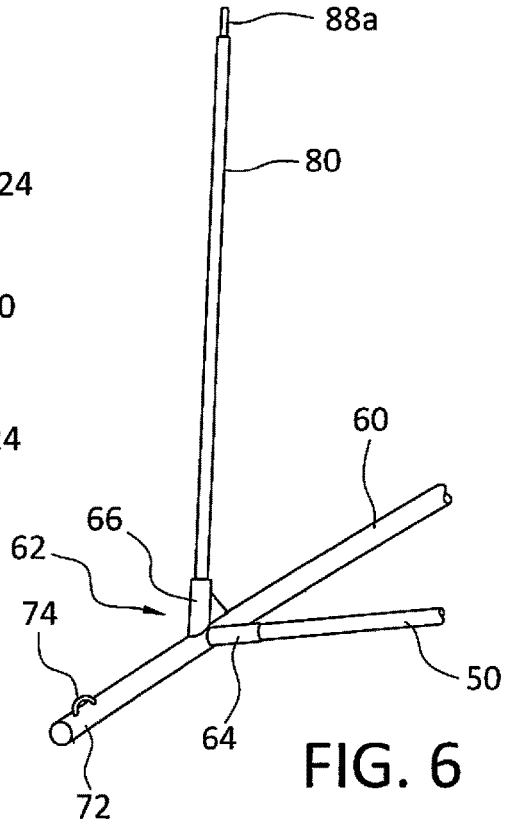
FIG. 6 is a front elevational view of the base and one of the vertical support rods or posts of the backstop assembly of FIG. 1.
Figure 7:
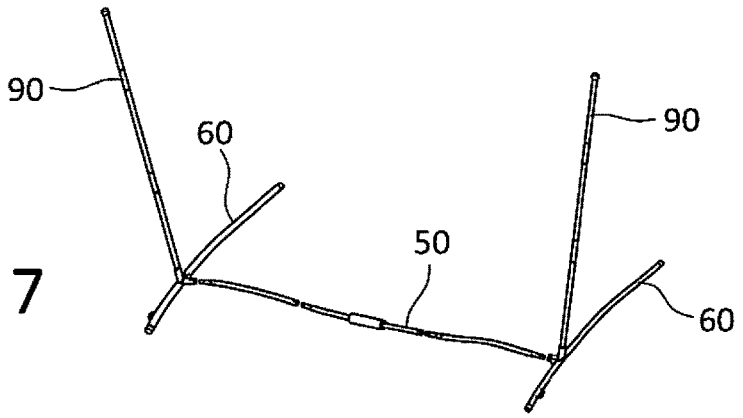
FIG. 7 is a front elevational view of the base and the vertical support rods of the backstop assembly of FIG. 1.

FIG. 6 shows the base 50 secured to the side legs 60, and one of the vertical rods 90 secured to one of the side legs 60. Together, the base 50, side legs 60 and vertical rods 90 comprise the support for the net 20. See also FIG. 7.

Optionally, rear leg extenders 70 are removably joined to the rear portions 68 of the side legs 60. When used, the rear leg extenders 70 slidably engage into the rear portions 68 of the side legs 60. Either the rear leg extenders 70, the side legs 60 or both may be staked to a ground surface with one or more stakes 76.

The front portions 72 of the side legs 60 may include a loop or hook 74 adapted to engage with a hook or loop 46 of a bungee cord 44.

Figure 5:
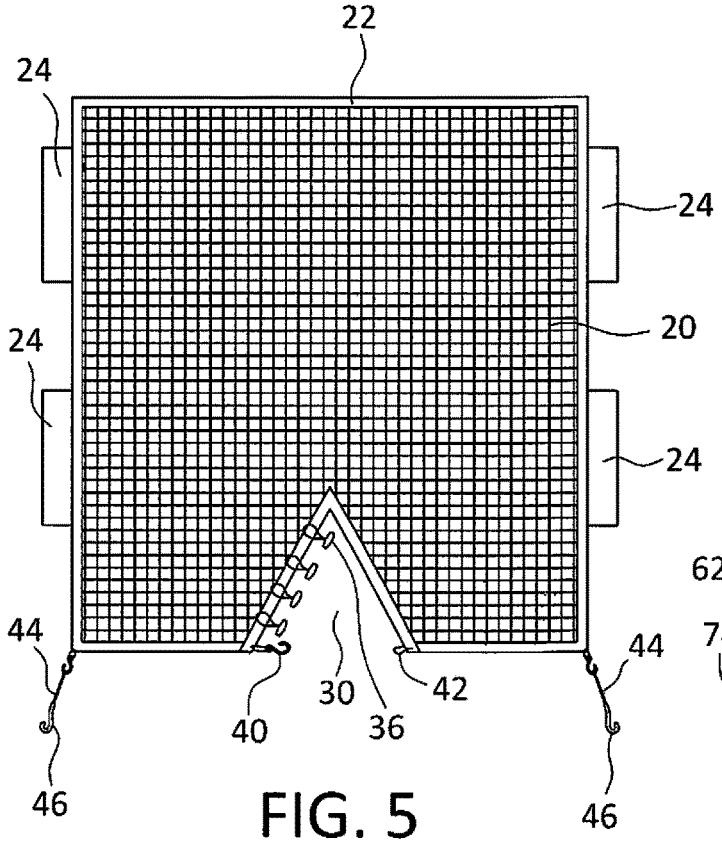
FIG. 5 is a front elevational view of a net of the backstop assembly of FIG. 1.

As shown in FIG. 5, the net 20 has a peripheral border 22 with side pockets 24 extending outwardly from the left and right side sections of the peripheral border 22. The side pockets 24 are shaped to receive the vertical posts or rods 90. Corner loops 26 are engaged to the top corners of the net peripheral border 22. Bungies or other stretchy cords 44 are engaged to the bottom corners of the net peripheral border 22. The bungies 44 terminate with hooks 46 adapted to engage with a respective loop or hook 74 of the front portions 72 of the side legs 60.

The bottom portion of the peripheral border 22 of the net 20 defines a slit opening 30. The slit opening 30 shown in FIG. 5 extends into the net 20 about ⅙ to ⅕ of the height of the net. One or more fasteners 36 such as toggles, are appended to the left side 32 of the slit opening 30. The right side 34 of the slit opening 30 may be joined to the left side 32 using the fasteners 32. In addition, the bottom portion of the net peripheral border 22 may have a hook 40 appended to the left side 32 of the slit opening 30 and a loop 42 extending from the right side 34 of the slit opening 30. The hook 40 may engage with the loop 42 to join the right side 34 of the slit opening 30 to the left side 32 of the slit opening 30. See FIGS. 14 and 15.

In the embodiment shown in the Figures, the vertical rods 90 comprise two sections. Referring to FIG. 6, a bottom section 80 of one of the vertical rods 90 is removably insertable into the socket opening 66 in a side leg 60. The proximal end of the bottom section has a threaded section 88*a* by which the bottom section 80 may be coupled to a top section 82 with a mating threaded section 88*b*. The distal end of the top section 82 terminates in a knob 84 or other protrusion to which one of the loops 26 at the top of the net peripheral border 22 may be joined. See FIGS. 7 and 11. Similarly, the other vertical rod 90 may be assembled and inserted into the socket opening 66 of the other side leg 60.

Figure 8:
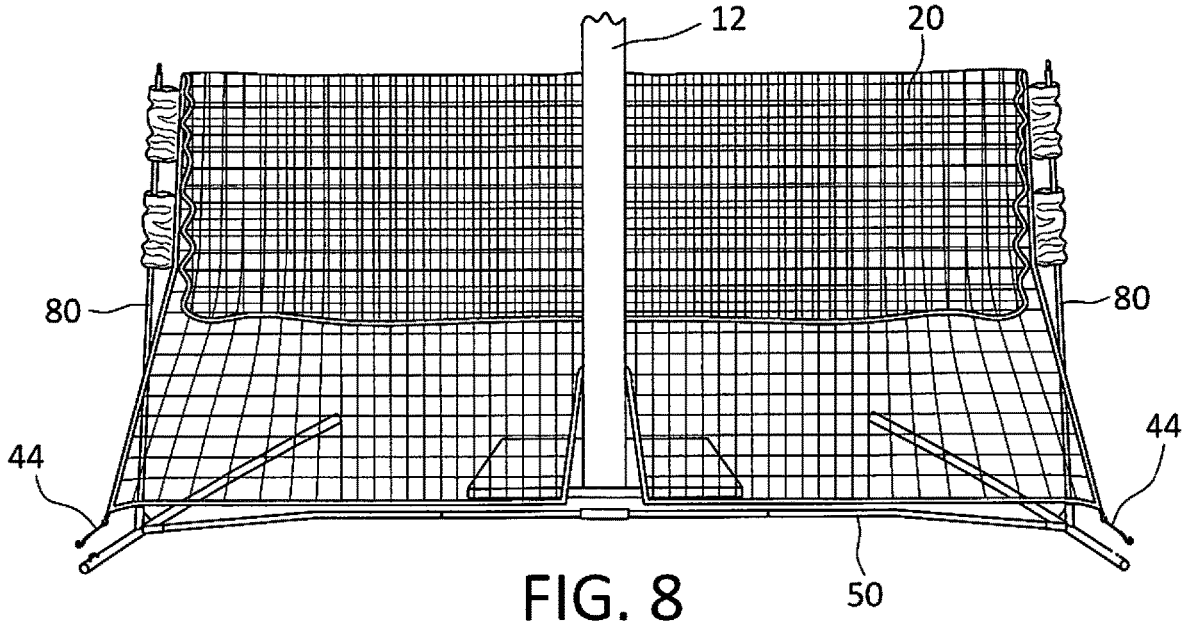
FIG. 8 is a front elevational view of a first step in attaching the net to the base and rods/posts of the backstop assembly of FIG. 1.
Figure 9A:
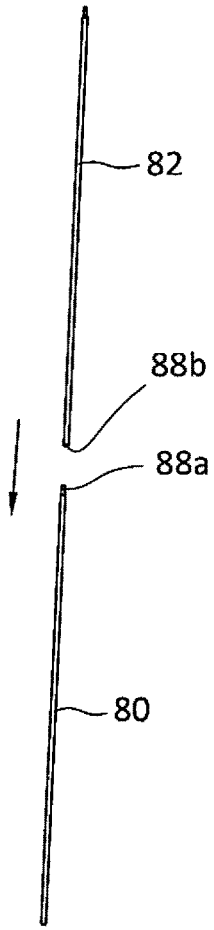
FIGS. 9 and 9A are front elevational views of a second step in attaching the net to the base and rods/posts of the backstop assembly of FIG. 1.
Figure 9:
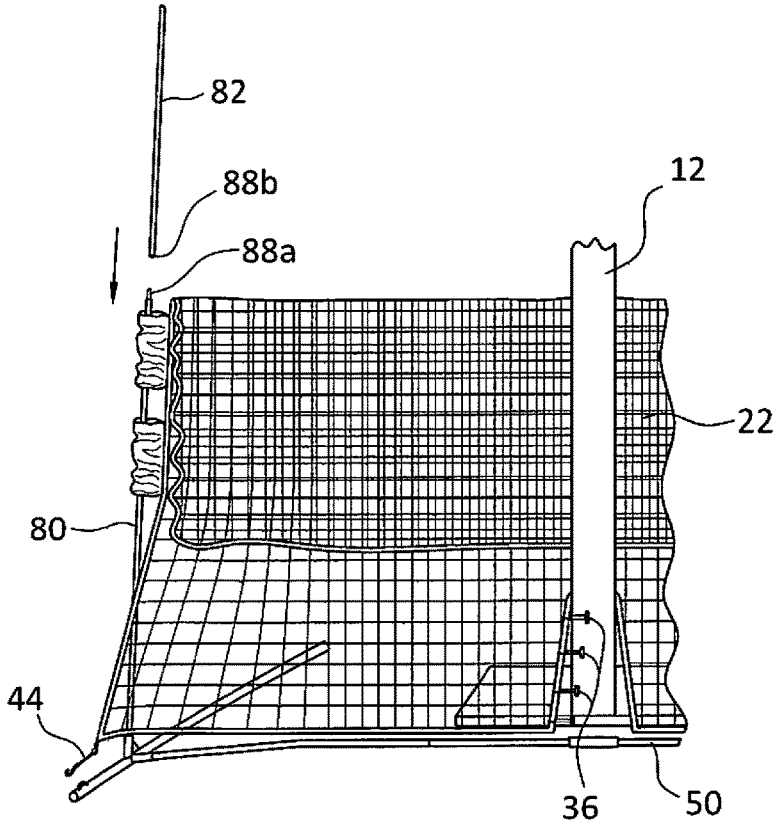
Figure 10:
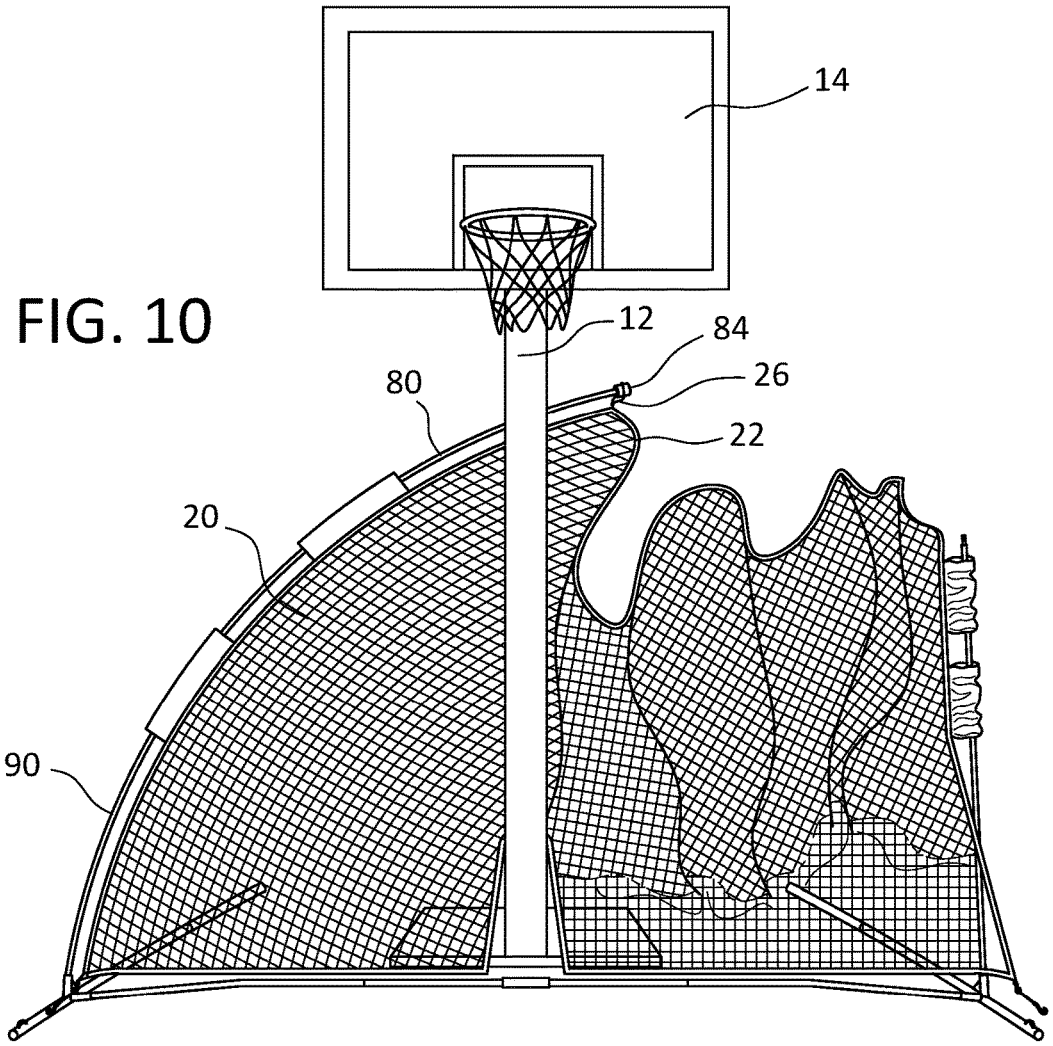
FIG. 10 is a front elevational view of a third step in attaching the net to the base and rods/posts of the backstop assembly of FIG. 1.
Figure 11:
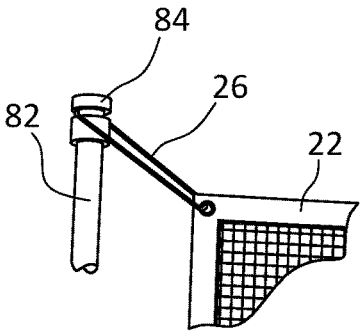
FIG. 11 is an enlarged view showing attachment of a loop extending from a top corner of the net to a top of a vertical rod of the backstop assembly of FIG. 1.
Figure 13:
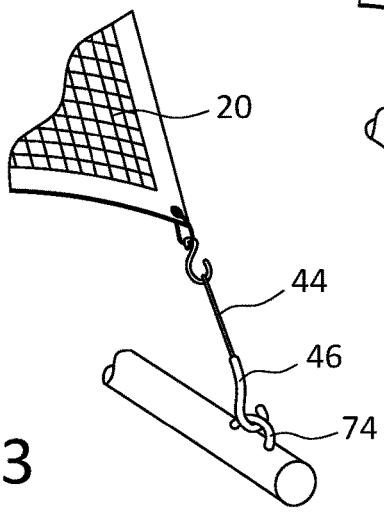
FIG. 13 is an enlarged view showing attachment of a hook on a bungee extending from a bottom corner of the net assembly to a front of a side leg of the backstop assembly of FIG. 1.
Figure 12:
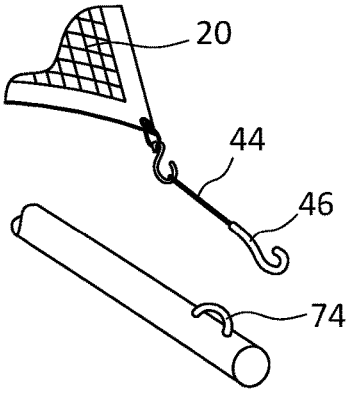
FIG. 12 is a front elevational view of a fourth step in attaching the net to the base and rods/posts of the backstop assembly of FIG. 1.
Figure 14:
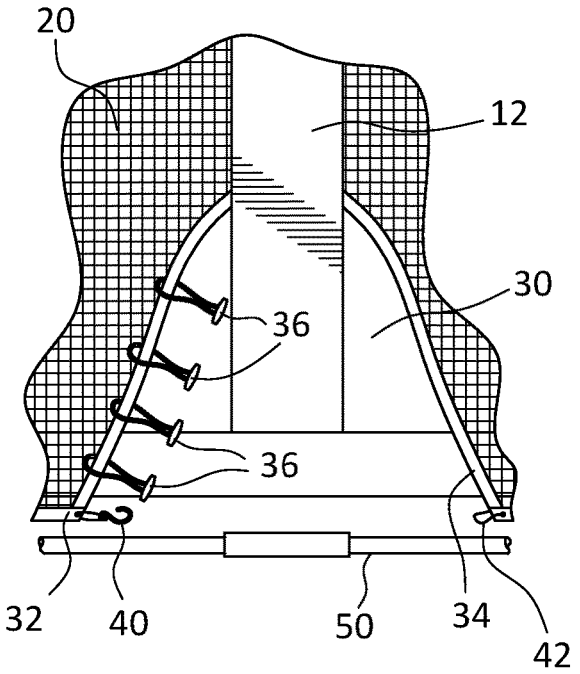
FIG. 14 is an enlarged view of a slit opening in a bottom portion of the net of the backstop assembly of FIG. 1, showing engagement of the slit opening around the post of the basketball backboard.
Figure 15:
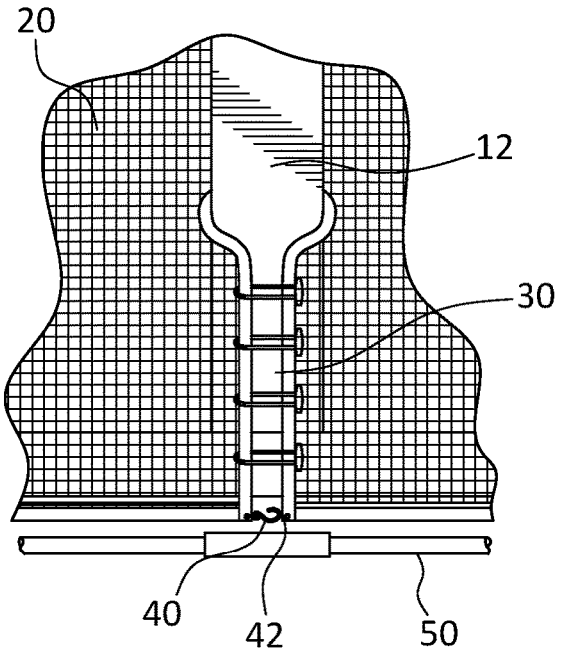
FIG. 15 is an alternative enlarged view of the slit opening in a bottom portion of the net of the backstop assembly of FIG. 1 showing engagement of the slit opening around the post of the basketball backboard.

Referring next to FIGS. 8-10, the basketball backstop assembly 10 is assembled adjacent to a post 12 of a basketball backboard 14. The base 50 is placed in front of the post 12. The net 20 is placed behind the post 12. The slit opening 30 in the net 20 is opened so that the post 12 extends through the slit opening 30. See FIG. 14.

The net 20 is joined to the vertical rods 90 and side legs 60 according to the following steps. First, the vertical rods 90 are threaded through respective pockets of sleeves 24 at each side of the net 20. See FIGS. 8, 9 and 9A. The loops 26 at the top corners of the net 20 are joined to the respective knobs 84 at the tops of the vertical rods 90 to the left and right of the assembly 10. See FIGS. 7 and 11. The vertical rods 90 preferably are formed of fiberglass or other flexible material. The rods 90 are flexible and, based on the angle of the sockets 66 and rod material flexibility, the rods 90 bend away from one another stretching the top portion of the net 20. The top of the net peripheral border 22 thus is held in tension behind the backboard 14 as shown in FIGS. 1, 2 and 16.

The hooks 46 on the bungie cords 44 extending from the bottom corners of the net 20 are joined to the respective loops or hooks 74 at the front portions of the side legs 60. See FIGS. 9, 12 and 13.

Finally, the hook 40 may be joined to the loop 42 on the net peripheral border 22 at or adjacent to the slit opening 30. In addition, the right side 34 of the slit opening 30 may be joined to the fasteners 36 on the left side 32 of the slit opening 30. In this manner, the slit opening is closed around the post 12. See FIGS. 14 and 15.

The freestanding assembled basketball backstop assembly 10 rebounds or returns basketballs to a player. Basketballs tossed toward the basketball backboard 12 and hoop 16 that drop onto the net 20 are bounced off the net and rebounded or returned toward the player.

Figure 18:
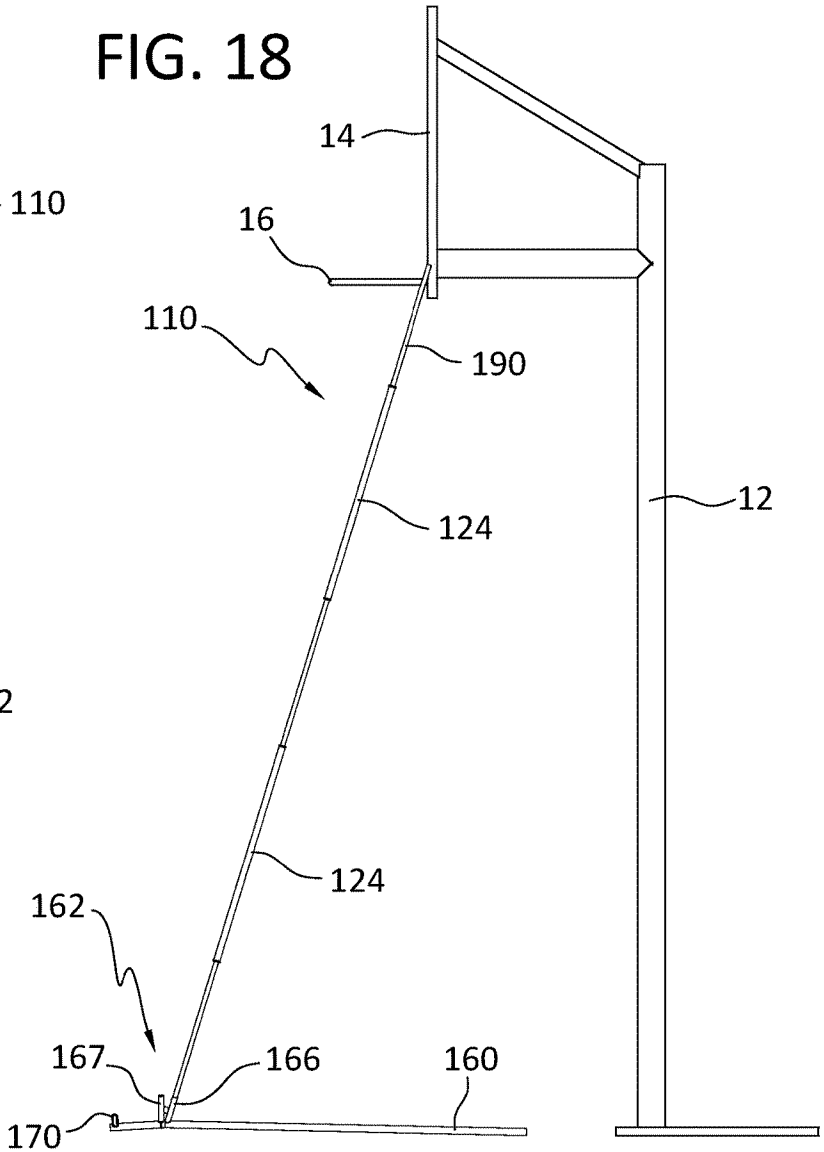
FIG. 18 is a right side elevational view of the backstop assembly of FIG. 17.
Figure 17:
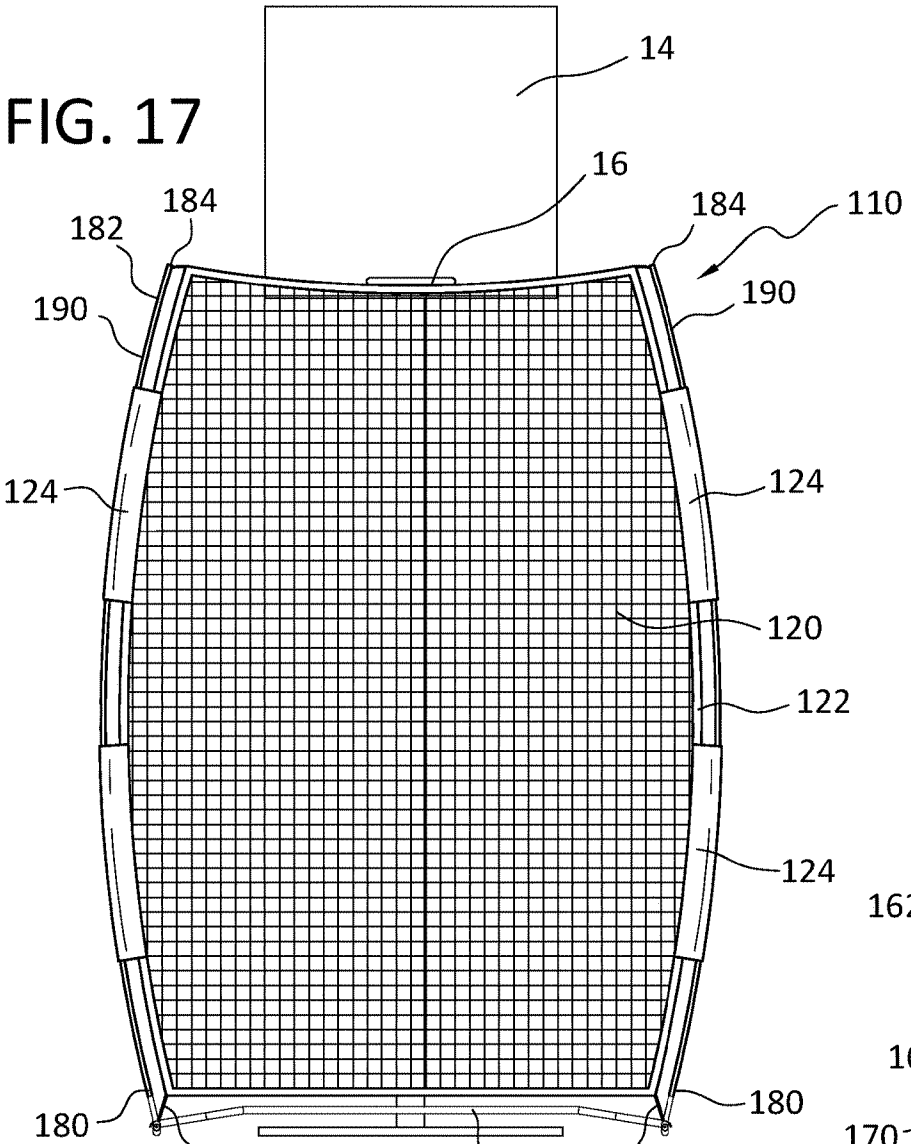
FIG. 17 is a front elevational view of a backstop assembly according to a second embodiment of the invention in which the net is held at an angle from vertical in front of a basketball backboard.
Figures 19, 20:
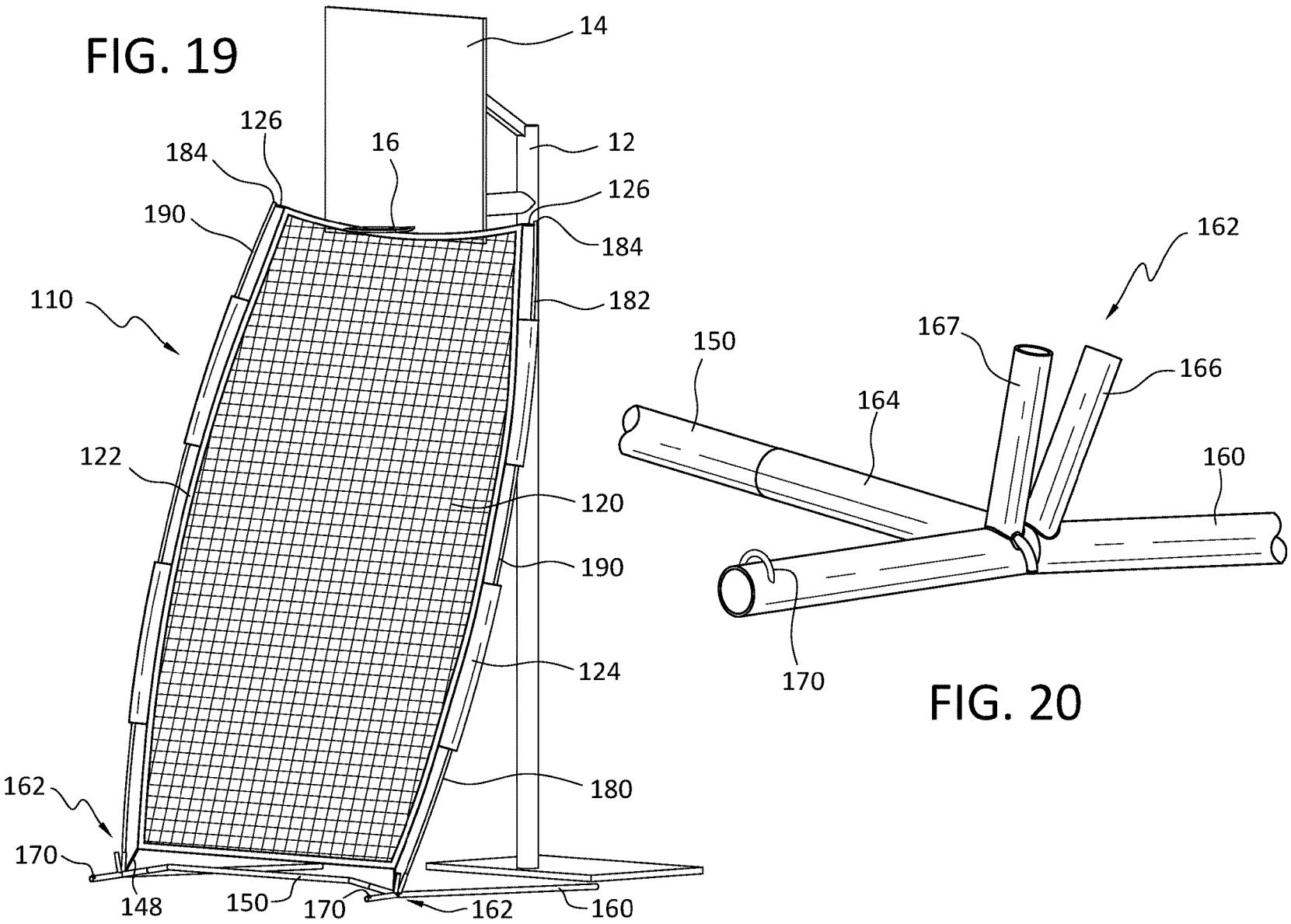
FIG. 19 is a perspective view of the backstop assembly according to FIG. 17.
FIG. 20 is an enlarged view of a socket unit on a side leg of the backstop assembly according to FIG. 17.
Figure 22:
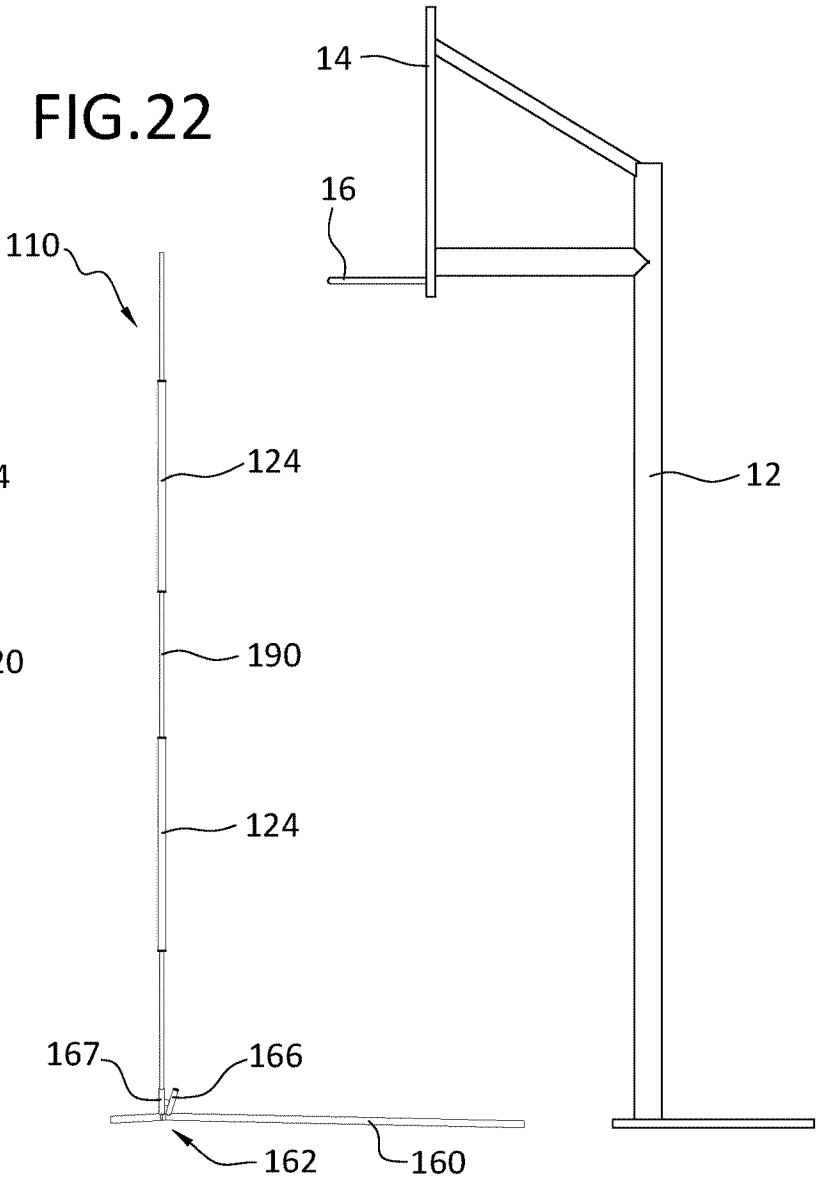
FIG. 22 is a right side elevational view of the backstop assembly of FIG. 21.
Figure 21:
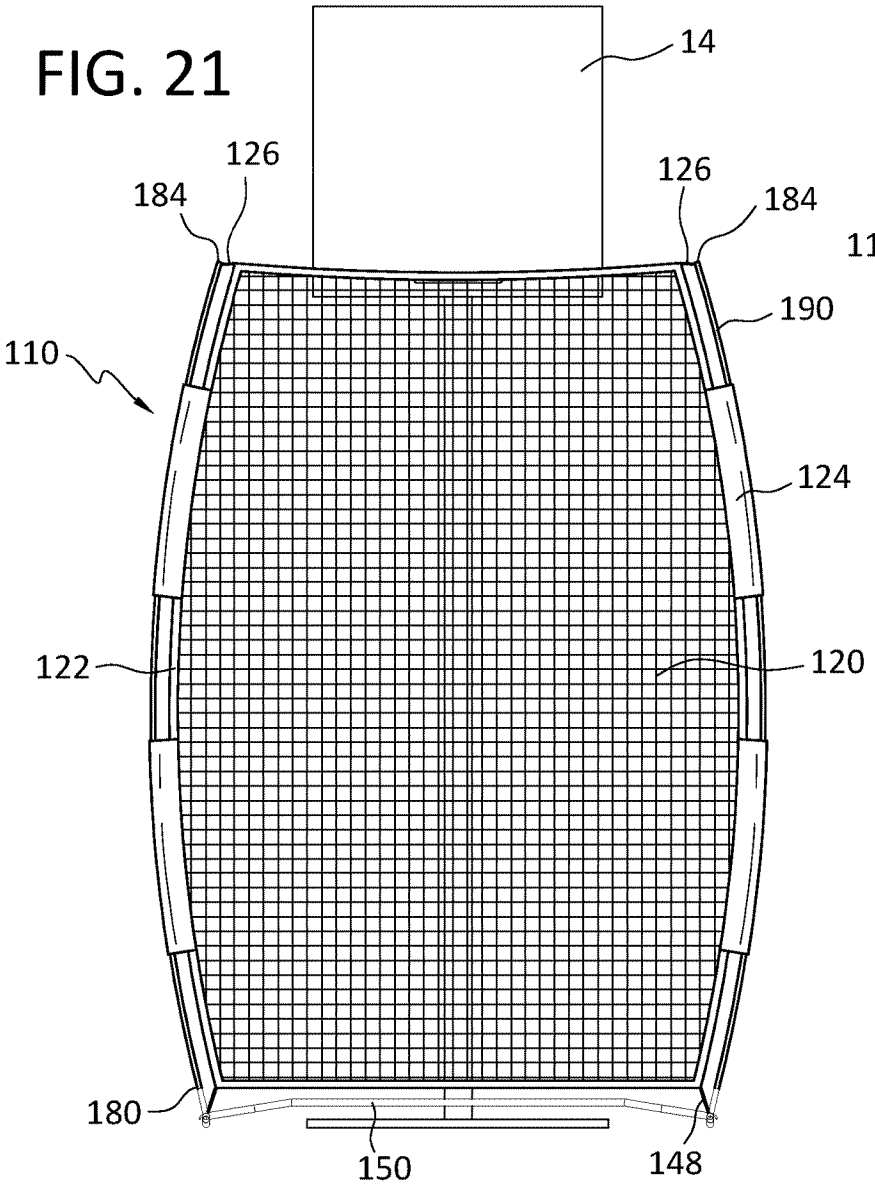
FIG. 21 is a front elevational view of the backstop assembly of FIG. 17 in which the net is held vertically or substantially vertically.
Figure 23:
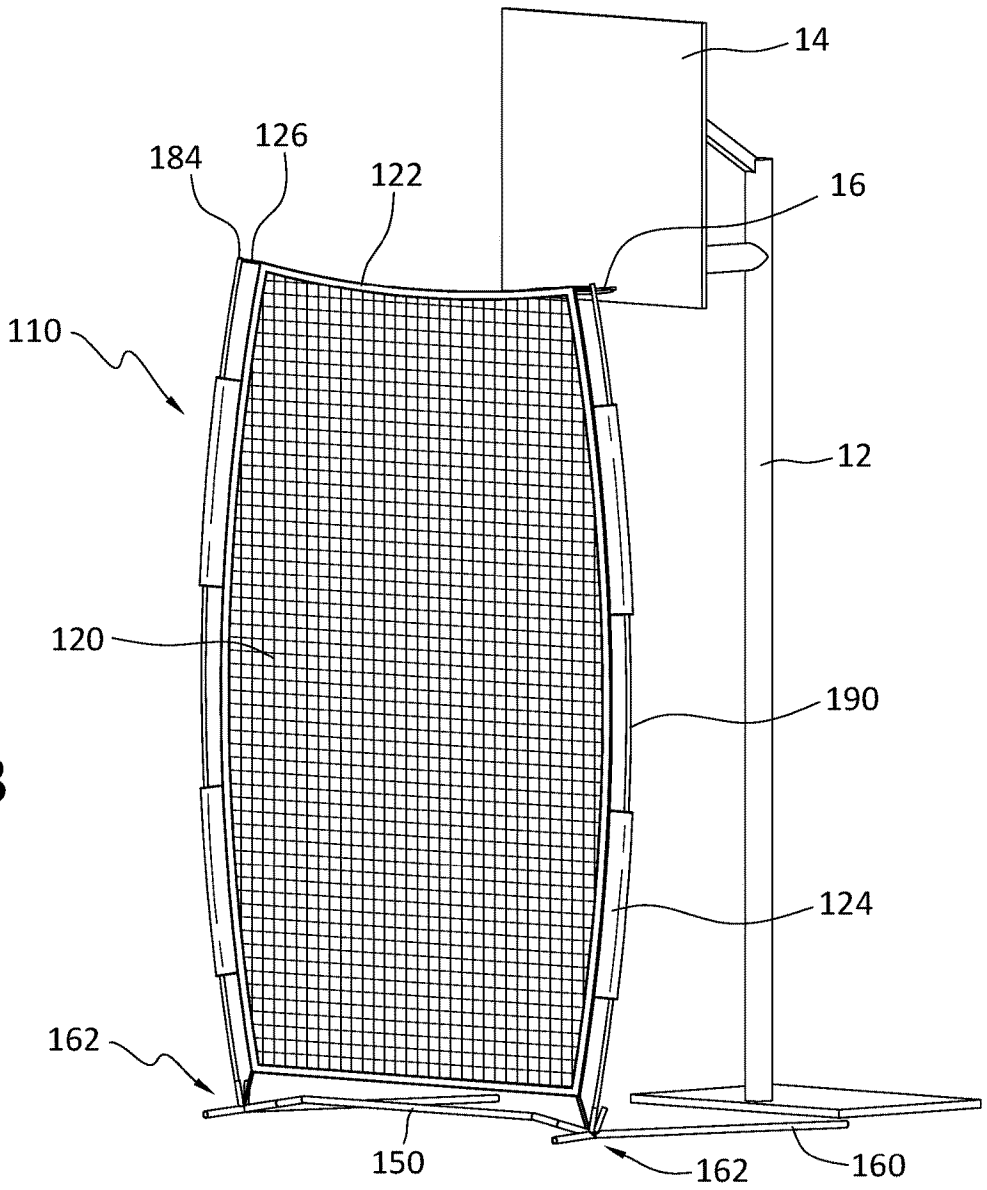
FIG. 23 is a perspective view of the backstop assembly of FIG. 21.

A second embodiment of a basketball backstop assembly 110 is shown in FIGS. 17-23. The basketball backstop assembly 110 has a base 150 connected to a right side leg 160 and a left side leg 160. The net 120 has a net periphery 122 from which sleeves 124 extend. The sleeves 124 define pockets configured to receive the vertical rods 190 that support the net 120 in an upright position. The vertical rods 190 may be a single piece or made up of connected pieces, preferably of fiberglass or other flexible material. The top corners of the net 120 are joined to the top portions 182 of the vertical rods 190 by cords 126. The bottom corners of the net 120 are joined to socket units 162 by cords 148. The bottom ends 180 of the vertical rods 190 are fitted into sockets 166 or 167 of the socket units 162 as desired by the user. If the vertical rods 190 are secured into the sockets 166 that are disposed at an angle from vertical, the net 120 will be held at an angle from vertical or substantially vertical as shown in FIGS. 17-19. If the vertical rods 190 are secured into the sockets 167 that are disposed at about a 90-degree angle from the side legs 160, the net 120 will be held vertically or substantially vertically to the support surface as shown in FIGS. 21-23.

When the basketball backstop assembly 110 is held at an angle that is different from vertical or substantially vertical (FIGS. 17-19), the top portion of the net 120 may be placed under or adjacent the backboard 14 of the basketball hoop 16. In this position relative to the basketball hoop 16 the basketball backstop assembly 110 may be used to rebound or return basketballs to the player.

Alternatively, when the basketball backstop assembly 110 is held at a vertical or substantially vertical angle such as shown in FIGS. 21-23, the basketball backstop assembly 110 may be positioned in front of the basketball backboard 14. The assembly 110 in such orientation may be used as a barrier for the player to shoot around or over. Alternatively, the assembly 110 in the orientation shown in FIGS. 21-23 may be used as a practice net, such as for a volleyball player to practice setting and spiking.

Optionally, securement loops 170 may be welded at front portions or toe portions of the side legs 160. Securement loops 170 are configured to receive the hook end of a cord or bungee (e.g., 46 in FIG. 3) (or the end of the cord 148 in FIGS. 17 and 19) so that the bottom front corners of the net, e.g. 120, are held forwardly, creating a different ramp angle at the front face of the net 120.

A third embodiment of the basketball backstop assembly 210 is shown in FIGS. 24-27. The basketball backstop assembly 210 includes a base 250 that is joined to the right and left side legs 260 by socket units 262. The socket units 262 each have a socket 266 disposed at an angle to the respective side leg 260 to which the socket unit 262 is attached. The side legs 260 each have a rear end 268 and a front end 272. In the orientation of FIG. 24, the vertical rods 290 supporting the net 200 are held at an angle with respect to the support on which the base 250 and the side legs 260 are set. The angle may be between 45 degrees and 85 degrees from the side leg 260. The vertical rods 290 may be a single piece or made up of connected pieces, preferably of fiberglass or other flexible material. In this position relative to the basketball hoop 16 the basketball backstop assembly 210 may be used to rebound or return basketballs to the player.

Risers 292 each have a post 294 to which a channel 296 is secured at one end. The channel 296 is configured to receive a portion of a side leg 260. The channel 296 defines a hole 298 that may receive a spring pin or detent pin 263 that extends from the side leg 260. The pin 263 secures the sidewall of the side leg 260 to the channel 296.

As shown in FIGS. 25 and 27, the side legs 260 are received into respective channels 296 of the risers 292. The rear ends 268 of the side legs 260 are thereby raised up away from the support surface. When so raised, the orientation of the vertical posts 290 held in the socket units 262 is changed from an angle different from vertical or substantially vertical, to an angle that is vertical or substantially vertical (FIG. 25). In the orientation of FIG. 25, the basketball backstop assembly can be used as a defender barrier or a sports practice net.

Figure 29:
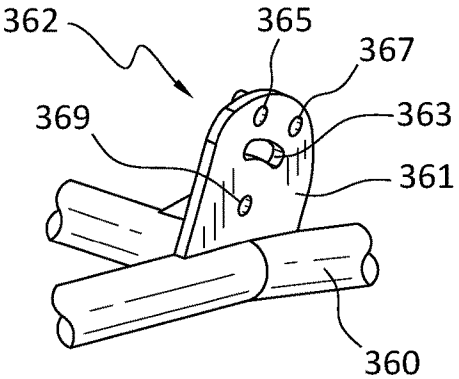
FIG. 29 is an enlarged perspective view of a flange associated with a side leg of the backstop assembly of FIG. 28, which flange defines an arcuate slot and receiving holes.
Figure 30:
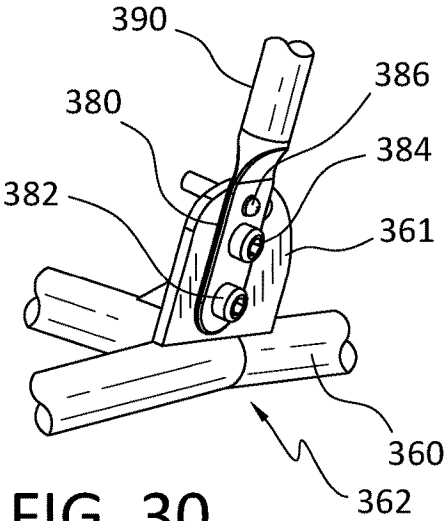
FIG. 30 is an enlarged perspective view of the flange of FIG. 29 to which a vertical rod is attached to hold the vertical rod at the first angle from vertical.
Figure 28:
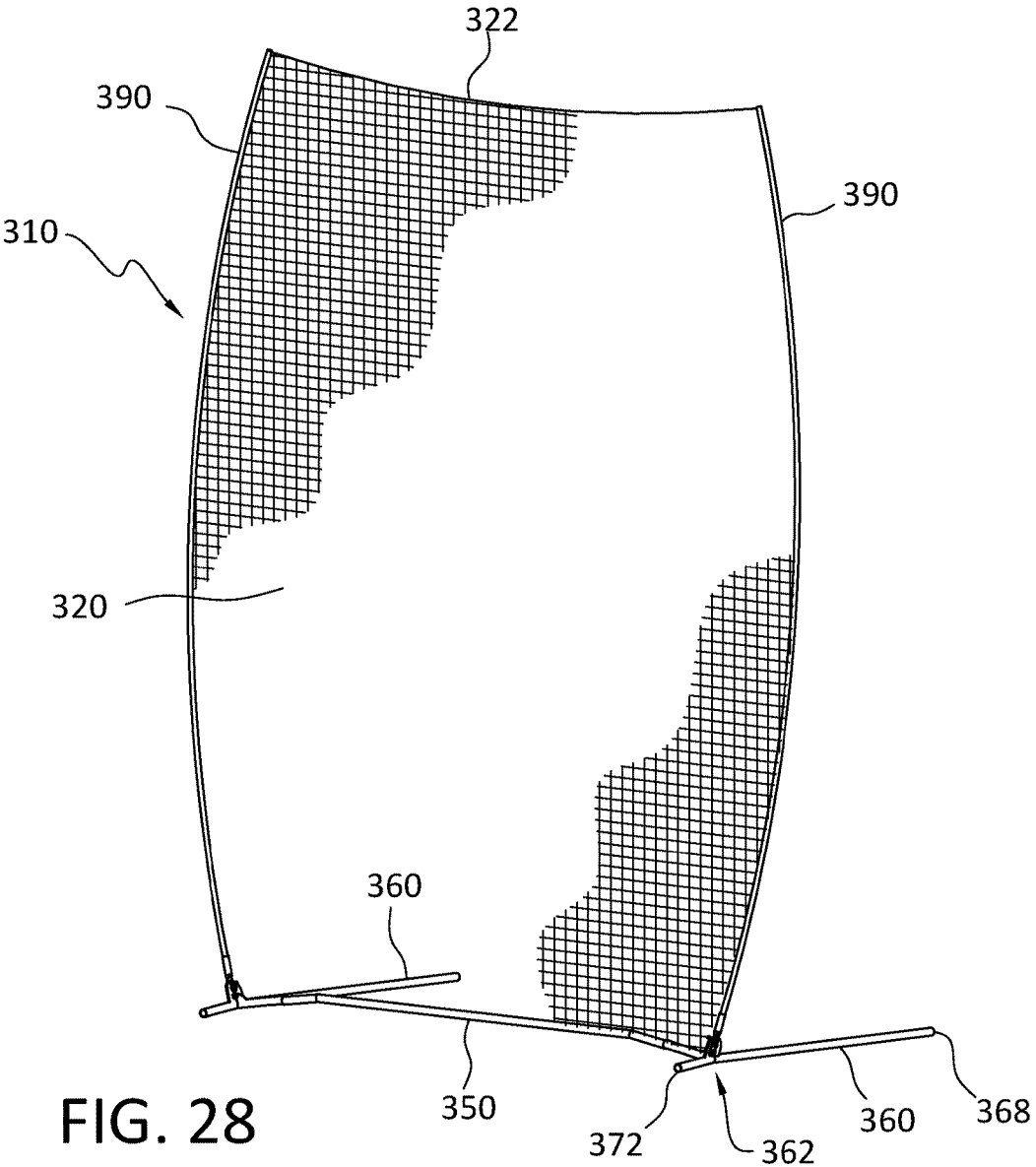
FIG. 28 is a right side perspective view of a backstop assembly according to a fourth embodiment of the invention in which the net is held at a first angle from vertical.

A fourth embodiment of a basketball backstop assembly 310 is shown in FIGS. 28-30. The assembly 310 has a base 350 joined to a right side leg and a left side leg 360. The side legs 360 have a back end 368 and a front end 372. A socket unit 362 has a flange 361 that projects from the side leg 360. The flange 361 defines an arcuate slot 363 spaced apart from a pivot defined by hole 369. Also spaced apart from the arcuate slot 363 are holes 365, 367. The vertical rods 390 support a net. The vertical rods 390 may be a single piece or made up of connected pieces, preferably of fiberglass or other flexible material. The vertical rods 390 have a terminal end 380 that is rotatably joined to the flange 361. The terminal end 380 may be joined to the pivot hole 369 by a first bolt 382. A second bolt 384 is secured to the terminal end 380 and is held in the arcuate slot 363. A spring pin 386 or cotter pin assembly associated with the terminal end 380 of the vertical rod 390 seats inside one of the holes 365, 367. The orientation of the net 320 suspended by the vertical rods 390 may be adjusted by moving the terminal ends 380 of each vertical rod 390 from one hole 365 to another hole 367. In a variation the bottom portions of the first vertical rod and the second vertical rod may be forked, such as in the form of an inverted U, with one fork prong on one side of the respective flange and a second fork prong on an opposite side the respective flange, and with both forks joined to the respective bolt that is held in the arcuate slot of the flange.

In the orientation shown in FIGS. 28 and 30, the vertical rods 390 place the net vertical or substantially vertical to the support surface. In the orientation of FIGS. 28 and 30, the basketball backstop assembly can be used as a defender barrier or as a sports practice net. If the terminal end 380 of the vertical rod 390 is angularly adjusted to place the spring pin 386 into the alternative hole 367, then the vertical rods 390 place the net at an angle that is not vertical or substantially vertical. In this other orientation, the basketball backstop assembly can be used to rebound or return basketballs to a player.

Figures 31, 32, 33, 34, 35:
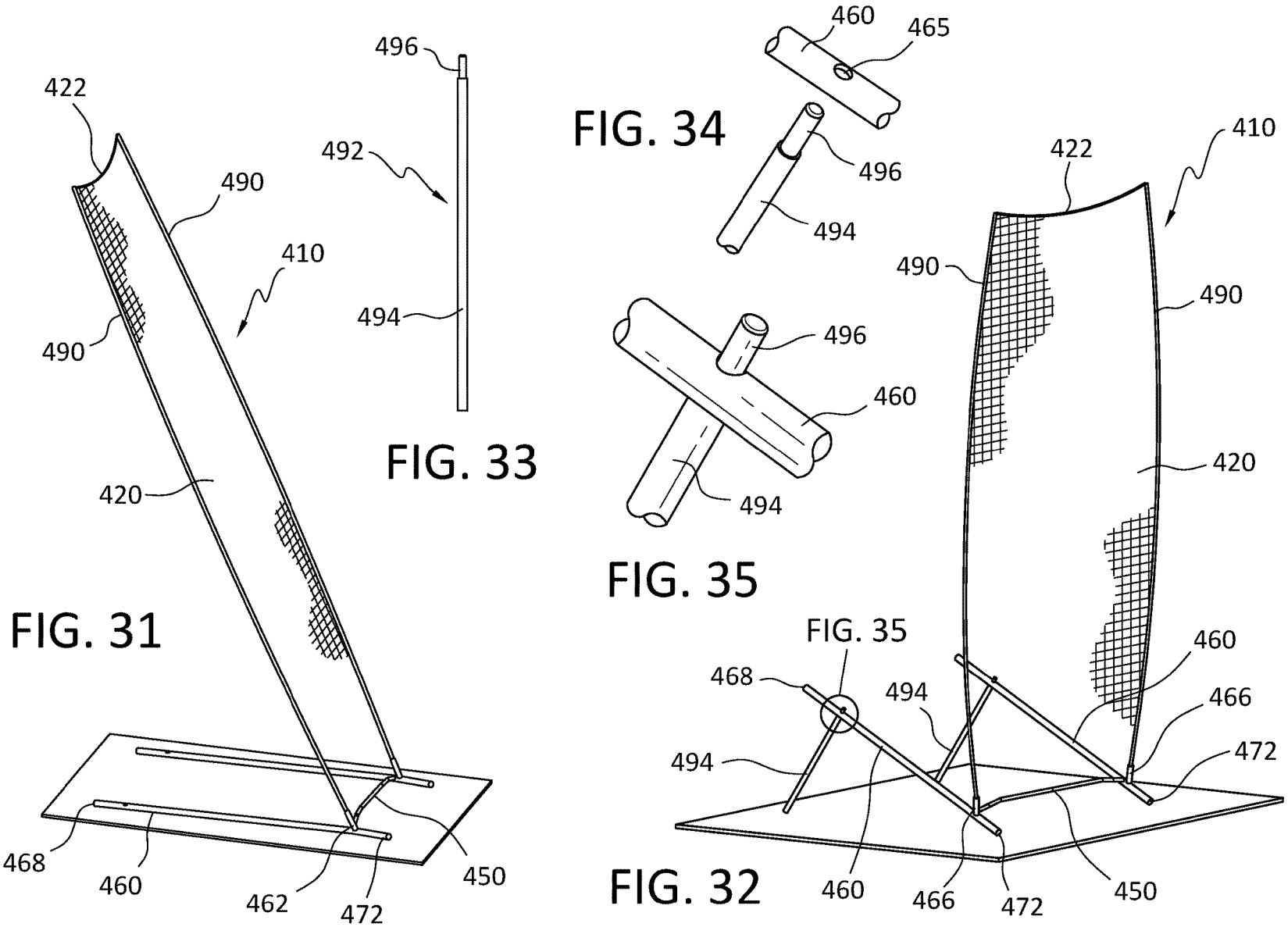
FIG. 31 is a left side perspective view of a backstop assembly according to a fifth embodiment of the invention in which the net is held at a first angle from vertical.
FIG. 32 is a left side perspective view of the backstop assembly of FIG. 31 in which the net is held at a second angle that is vertical or substantially vertical.
FIG. 33 is an enlarged perspective view of a back leg support post for the backstop assembly of FIG. 31.
FIG. 34 is an enlarged perspective view of means for connecting the back leg support post to the back leg for the backstop assembly of FIG. 31.
FIG. 35 is an enlarged perspective view of the back leg support post connected to the back leg for the backstop assembly of FIG. 31.

A fifth embodiment of a basketball backstop assembly 410 is shown in FIGS. 31-35. The basketball backstop assembly 410 includes a base 450 that is joined to the right and left side legs 460 by socket units 462. The socket units 462 each have a socket 466 disposed at an angle to the respective side leg 460 to which the socket unit 462 is attached. The side legs 460 each have a rear end 468 and a front end 472. In the orientation of FIG. 31, the vertical rods 490 supporting the net are held at an angle with respect to the support on which the base 450 and the side legs 460 are set. The angle may be between 45 degrees and 85 degrees from the side leg 460. The vertical rods 490 may be a single piece or made up of connected pieces, preferably of fiberglass or other flexible material. In this position relative to the basketball hoop 16 the basketball backstop assembly 410 may be used to rebound or return basketballs to the player (FIG. 31).

Risers 492 each have a post 494 that terminates at a top end with a pin 496. See FIG. 33. The pin 496 is configured for insertion into a hole or series of holes 465 formed in the sidewall of a respective side leg 460. The pin 496 secures the riser 492 to the sidewall of the side leg 460. See FIGS. 34 and 35. The pin 496 may define a hole therethrough through which a cotter pin may be inserted. Such cotter pin secures engagement between the riser 492 and the respective side leg 460.

As shown in FIG. 32, when the risers 492 are secured to the side legs 460, the rear ends 468 of the side legs 460 are thereby raised up away from the support surface. When so raised, the orientation of the vertical posts 490 held in the socket units 462 is changed from an angle different from vertical or substantially vertical, to an angle that is vertical or substantially vertical (FIG. 32). In the orientation of FIG. 32, the basketball backstop assembly can be used as a defender barrier or a sports practice net.

Figure 36:
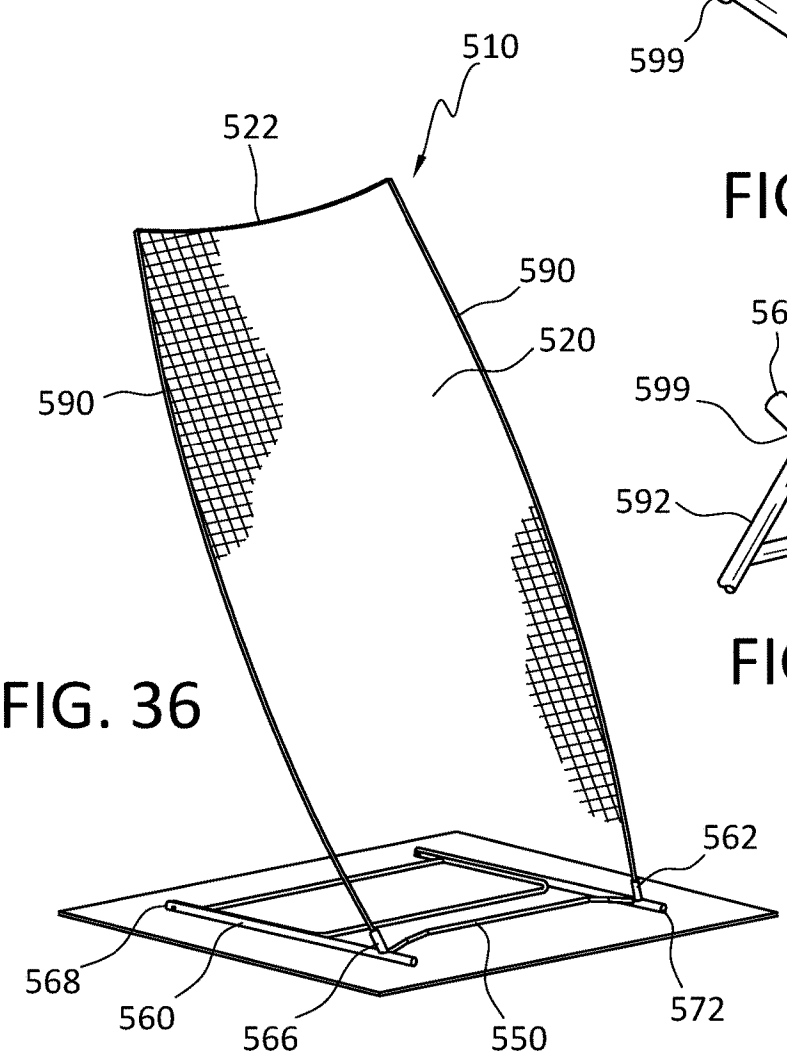
FIG. 36 is a left side perspective view of a backstop assembly according to a sixth embodiment of the invention in which the net is held at a first angle from vertical.
Figure 43:
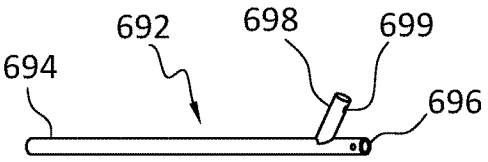
FIG. 43 is an enlarged perspective view of the back leg extension of FIG. 42 separated from the back leg of the backstop assembly of FIG. 40.

A sixth embodiment of the basketball backstop assembly 510 is shown in FIGS. 36-39. The basketball backstop assembly 510 includes a base 550 that is joined to the right and left side legs 560 by socket units 562. The socket units 562 each have a socket 566 disposed at an angle to the respective side leg 560 to which the socket unit 562 is attached. The side legs 560 each have a rear end 568 and a front end 572. In the orientation of FIG. 36, the vertical rods 590 supporting the net are held at an angle with respect to the support on which the base 550 and the side legs 560 are set. The angle may be between 45 degrees and 85 degrees from the side leg 560. The vertical rods 590 may be a single piece or made up of connected pieces, preferably of fiberglass or other flexible material. In this position relative to the basketball hoop 16 the basketball backstop assembly 510 may be used to rebound or return basketballs to the player. See FIG. 36.

Figure 37:
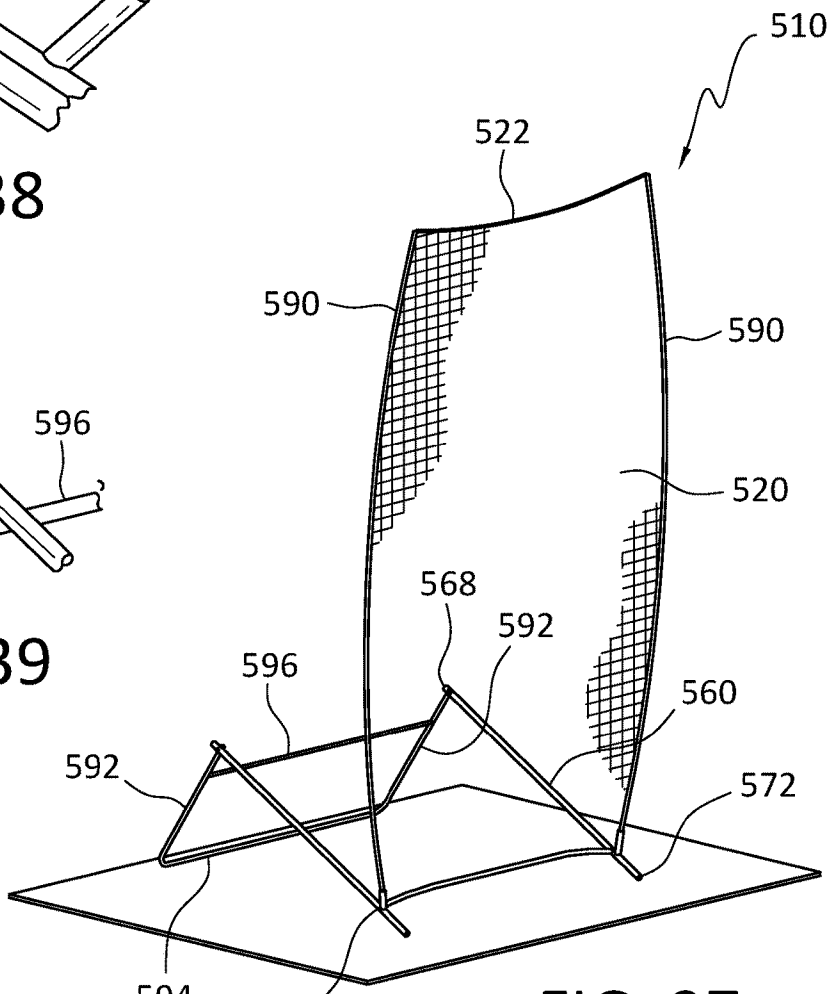
FIG. 37 is a left side perspective view of the backstop assembly of FIG. 36 in which the net is held at a second angle that is vertical or substantially vertical.
Figure 38:
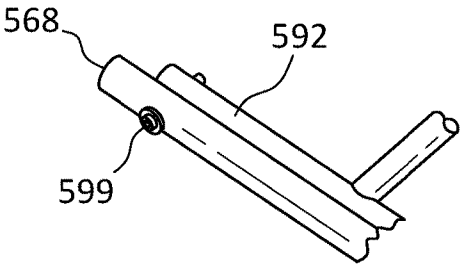
FIG. 38 is an enlarged perspective view of connection between the back leg and a back leg support for the backstop assembly of FIG. 36.
Figure 39:
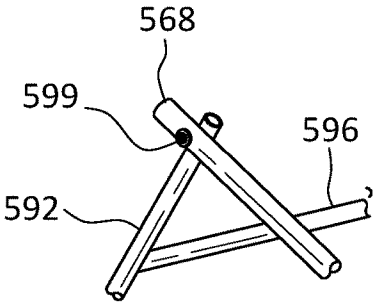
FIG. 39 is an enlarged perspective view of connection between the back leg and the back leg support port the backstop assembly of FIG. 37.

A leg stand has two riser legs 592 secured together by a first brace bar 594 and a second brace bar 596. A first of the riser legs 592 is joined for relative rotational movement to the left side leg 560 by a bolt 599 (see FIGS. 38 and 39). A second of the riser legs 592 is joined for relative rotational movement to the right side leg 560 by a bolt 599. When the leg stand is closed, the riser legs 592 are held in parallel or substantially parallel relation to the side legs 560 (see FIG. 36). When the orientation of the vertical rods 590 is to be adjusted, the leg stand is flipped, opened or rotated by rotating the riser legs 592 on the bolts 599 so that the leg stand raises and supports the back ends 568 of the side legs 560 to a position above the support surface. The bolts 599 are tightened to hold the first brace bar 594 in place with the riser legs 592 at a desired angle to the side legs 560. Alternative locking mechanisms optionally may be used. When the side legs 560 are so raised and supported, the orientation of the vertical posts 590 held in the socket units 562 is changed from an angle different from vertical or substantially vertical, to an angle that is vertical or substantially vertical (FIG. 37). In the orientation of FIG. 37, the basketball backstop assembly can be used as a defender barrier or a sports practice net.

Figure 40:
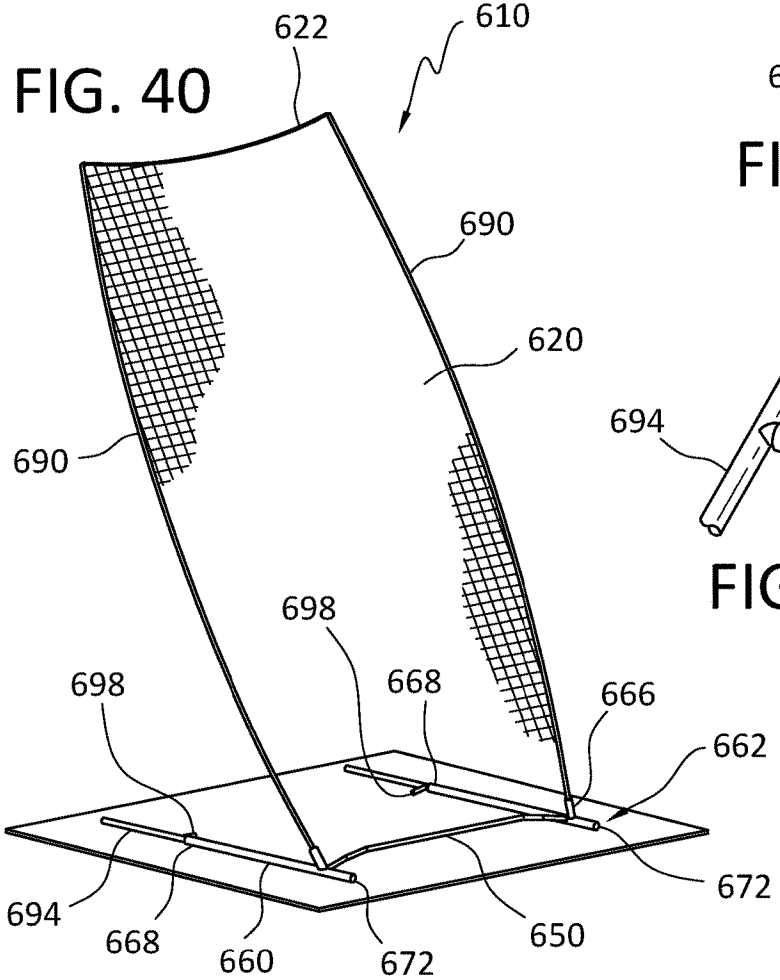
FIG. 40 is a left side perspective view of a backstop assembly according to a seventh embodiment of the invention in which the net is held at a first angle from vertical.

A seventh embodiment of a basketball backstop assembly 610 is shown in FIGS. 40-44. The basketball backstop assembly 610 includes a base 650 that is joined to the right and left side legs 660 by socket units 662. The socket units 662 each have a socket 666 disposed at an angle to the respective side leg 660 to which the socket unit 662 is attached. The side legs 660 each have a rear end 668 and a front end 672. In the orientation of FIG. 40, the vertical rods 690 supporting the net are held at an angle with respect to the support on which the base 650 and the side legs 660 are set. The angle may be between 45 degrees and 85 degrees from the side leg 660. The vertical rods 690 may be a single piece or made up of connected pieces, preferably of fiberglass or other flexible material. In this position relative to the basketball hoop 16 the basketball backstop assembly 610 may be used to rebound or return basketballs to the player. See FIG. 40.

Figure 42:
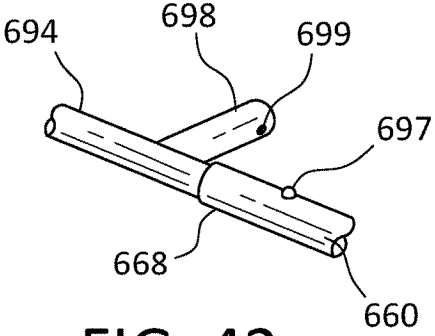
FIG. 42 is an enlarged perspective view of a back leg extension joined to a back leg of the backstop assembly of FIG. 40.

Risers 692 each have a post 694 that has a proximal end 696 and a distal end and a length between the proximal end 696 and distal end. The risers 692 function as side leg extensions when the risers 692 are joined to the rear ends 668 of respective side legs 660. As shown in FIGS. 40 and 42, the proximal end 696 of the riser 692 is inserted into the tubular opening at the rear end 668 of the side leg 660. A detent pin 697 that projects from a sidewall of the riser 692 releasably connects with a hole in the sidewall of the side leg 660.

Figure 41:
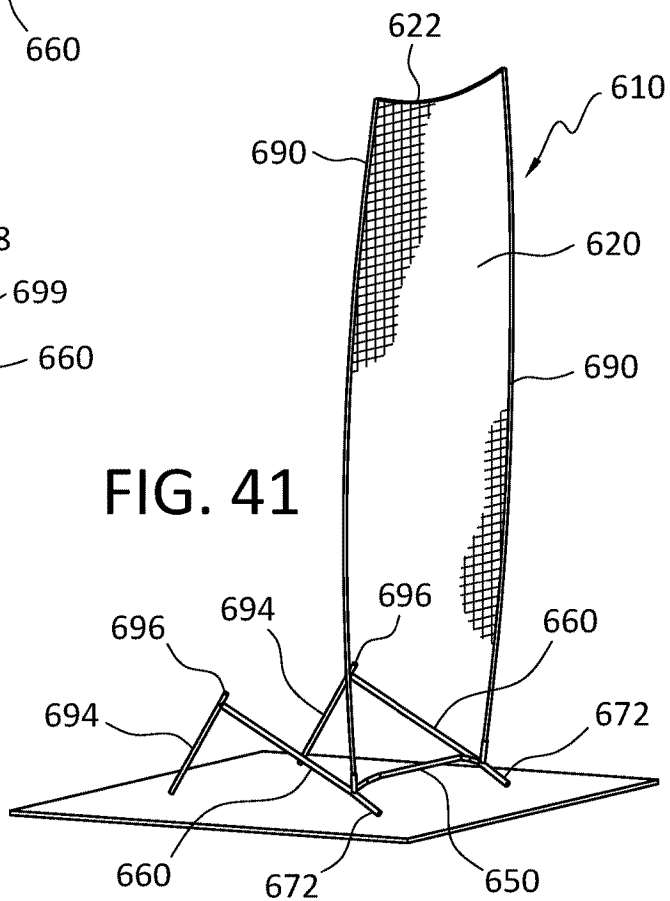
FIG. 41 is a left side perspective view of the backstop assembly of FIG. 40 in which the net is held at a second angle that is vertical or substantially vertical.
Figure 44:
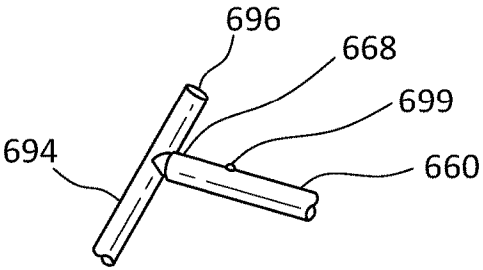
FIG. 44 is an enlarged perspective view of the back leg extension rejoined to the back leg to elevate and support the back leg of the backstop assembly of FIG. 41.

Risers 692 each have a projection 698 extending outwardly from the riser sidewall at an angle thereto. The projection 698 has a detent pin 699 projecting outwardly that is configured to mate with the hole in the sidewall of the side leg 660. As shown in FIGS. 41 and 44, the proximal ends 696 of the risers 692 are removed from the rear ends 668 of the side legs 660 and then the projections 698 from respective risers 692 are received into the rear ends 668 of the side legs 660. The rear ends 668 of the side legs 660 are thereby raised up away from the support surface and supported by the risers 692. When so raised, the orientation of the vertical posts 690 held in the socket units 662 is changed from an angle different from vertical or substantially vertical, to an angle that is vertical or substantially vertical (FIG. 41). In the orientation of FIG. 41, the basketball backstop assembly can be used as a defender barrier or a sports practice net.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

REFERENCE NUMBERS

10 basketball backstop assembly
12 vertical post for backboard
14 backboard
16 hoop
18 basketball net
20 net of the backstop assembly
22 net peripheral border
24 side sleeves/pockets
26 corner loops at top of net
30 slit opening
32 left side of slit
34 right side of slit
36 fasteners/toggles
40 hook on slit
42 loop on slit
44 bungee cord at net corner
46 hook on bungee cord
50 base
52 base bar sections
54 cable inside base bar sections
60 side legs
62 socket unit
64 socket opening to receive base sections
66 socket opening to receive vertical bars
68 rear portions of side legs
70 rear leg extenders
72 front of side legs
74 loop or hook
76 stake
80 bottom section of vertical rod
82 top section of vertical rod
84 knob on top of top section
88*a*, 88*b* coupling for top and bottom rod sections
90 vertical rods
110 basketball backstop assembly
120 net
122 net periphery
124 side sleeves/pockets
126 corner loops at top of net
148 corner loops at bottom of net
150 base
160 side leg
162 socket unit
164 socket opening to receive base section
166 socket opening to receive vertical rods
167 socket opening to receive vertical rods
170 loop on side leg
180 bottom section of vertical rod
182 top section of vertical rod
184 knob on top section
190 vertical rod
210 basketball backstop assembly
220 net
222 net periphery
250 base
260 side leg
262 socket unit
263 spring pin
266 socket opening to receive vertical rod
268 back of side leg
272 front of side leg
290 vertical rod

292 leg riser
294 post of leg riser
296 channel of leg riser
298 hole in channel
310 basketball backstop assembly
320 net
322 net periphery
350 base
360 side leg
361 flange
362 socket unit
363 arcuate hole in flange
365 hole in flange
367 hole in flange
368 rear end side leg
369 hole or recess in flange
372 front end side leg
380 bottom end of vertical rod
382 bolt
384 bolt
386 spring pin
390 vertical rod
410 basketball backstop assembly
420 net
422 net periphery
450 base
460 side leg
462 socket unit
465 hole in side leg
466 socket
468 rear of side leg
472 front of side leg
490 vertical rod
492 leg riser
494 post
496 post tip
510 basketball backstop assembly
520 net
522 net periphery
550 base
560 side leg
562 socket unit
566 socket
568 back of side leg
572 front of side leg
590 vertical rod
592 riser leg
594 brace bar
596 brace bar
599 bolt
610 basketball backstop assembly
620 net
622 net periphery
650 base
660 side leg
662 socket unit
666 socket
668 rear of side leg
672 front of side leg
690 vertical rod
692 leg riser
694 post
696 post proximal end
697 detent pin
698 projection—angled from post sidewall
699 detent pin

The invention claimed is:

1. A basketball backstop assembly, comprising:

a base having a first end and a second end and a base length between the first end and the second end;

a right side leg having a right side length and defining a first axis along the right side length, said right side leg directly or indirectly joined to the first end of the base, a left side leg having a left side length and defining a second axis along the left side length, said left side leg directly or indirectly joined to the second end of the base, a net defining a peripheral border having a top, a bottom, a right side and a left side, said net having at least one right sleeve associated with the right side of the peripheral border and at least one left sleeve associated with the left side of the peripheral border;

a right vertical rod removably attachable to the right side leg, with a portion of the right vertical rod held in the right sleeve;

a left vertical rod removably attachable to the left side leg, with a portion of the left vertical rod held in the left sleeve; and net angle adjusting means configured to permit a user to change net orientation (a) from vertical or substantially vertical to at least one other net orientation at an angle different from vertical or substantially vertical, or (b) from the at least one other net orientation at an angle different from vertical or substantially vertical to the net origination of vertical or substantially vertical.

2. The basketball backstop assembly of claim 1, wherein the net angle adjusting means comprises a first socket unit associated with the right side leg and a second socket unit associated with the left side leg, wherein the first socket unit has a first socket and a second socket, and wherein the second socket unit has a third socket and a fourth socket, so that when a bottom portion of the right vertical rod is held in the first socket and a bottom portion of the left vertical rod is held in the third socket, the net is held in the net orientation that is vertical or substantially vertical, and when the bottom portion of the right vertical rod is held in the second socket and the bottom portion of the left vertical rod is held in the fourth socket, the net is held in the at least one other net orientation at an angle different from vertical or substantially vertical.

3. The basketball backstop assembly of claim 2, wherein the first socket unit has an additional socket configured to receive the first end of the base, and wherein the second socket unit has another socket configured to receive the second end of the base.

4. The basketball backstop assembly of claim 1, wherein the net angle adjusting means comprises a first flange associated with the right side leg and a second flange associated with the left side leg, wherein the first flange defines a first arcuate slot and wherein the second flange defines a second arcuate slot, and wherein a bottom portion of the first vertical rod is joined for rotation to the first flange with range of rotational movement of the first vertical rod relative to the first flange defined by the first arcuate slot, and wherein a bottom portion of the second vertical rod is joined for rotation to the second flange with range of rotational movement of the second vertical rod relative to the second flange defined by the second arcuate slot.

5. The basketball backstop assembly of claim 4, wherein the bottom portion of the first vertical rod is forked with one prong on a first side of the first flange and with a second prong on a second side of the first flange.

6. The basketball backstop assembly of claim 4, further comprising a first detent pin extending from the bottom portion of the first vertical rod and a second detent pin extending from the bottom portion of the second vertical rod, wherein the first flange defines at least two holes spaced apart from the first arcuate slot, with each of said holes selectively configured to receive the first detent pin, and wherein the second flange defines at least two other holes spaced apart from the second arcuate slot, with each of said other holes selectively configured to receive the second detent pin.

7. The basketball backstop assembly of claim 1, wherein the net angle adjusting means comprises a first riser engagable to the right side leg and a second riser engageable to the left side leg.

8. The basketball backstop assembly of claim 7, wherein the first riser comprises a post with a channel sleeve configured to receive a portion of the right side leg, and when so received, holds the portion of the right side leg above a support surface, and wherein the second riser comprises a second post with a second channel configured to receive a portion of the left side leg, and when so received, holds the portion of the left side leg above the support surface, so that net orientation is changed from an angle different from vertical or substantially vertical to an angle that is vertical or substantially vertical.

9. The basketball backstop assembly of claim 8, further comprising a first detent or first spring pin extending from a sidewall of the right side leg and configured to engage a hole in the channel sleeve, and a second detent or second spring pin extending from a sidewall of the left side leg and configured to engage a hole in the second channel sleeve.

10. The basketball backstop assembly of claim 7, wherein the first riser comprises a first post with a first top end and wherein the second riser comprises a second post with a second top end, and wherein the right side leg defines a hole or recess configured to receive the top end of the first post, and when so received, holds a portion of the right side leg above a support surface, and wherein the left side leg defines a second hole or recess configured to receive the second top end of the second post, and when so received, holds a portion of the left side leg above the support surface, so that net orientation is changed from an angle different from vertical or substantially vertical to an angle that is vertical or substantially vertical.

11. The basketball backstop assembly of claim 7, wherein the first riser comprises a first leg post with a first post top end and wherein the second riser comprises a second leg post with a second post top end, wherein the first post top end is rotatably joined to the right side leg and the second post top end is rotatably joined to the left side leg, so that when the first leg post is substantially parallel to the right side leg and the second leg post is substantially parallel to the left side leg, net orientation is at an angle different from vertical or substantially vertical, and when the first leg post is rotated and the second leg post is rotated, a portion of the right side leg and a portion of the left side leg are held above a support surface and the net orientation changes from the angle different from vertical or substantially vertical to an angle that is vertical or substantially vertical.

12. The basketball backstop assembly of claim 7, wherein the first riser comprises a first post having a length, said first post defining an axis along the length, with a first fitting at one end and a second fitting projecting from a sidewall of the first post, with each of the first fitting and the second fitting configured to be received selectively within an opening defined in the right side leg, and wherein the second riser comprises a second post having a second post length, said second post defining a second axis along the second post length, with a third fitting at one end of the second post and with a fourth fitting projecting a sidewall of the second post, with each of the third fitting and the fourth fitting configured to be received selectively within an opening defined in the left side leg, so that when the first fitting is held in the opening in the right side leg and the third fitting is held in the opening in the left side leg, net orientation is at an angle different from vertical or substantially vertical and when the second fitting is held in the opening in the right side leg and the fourth fitting is held in the opening in the left side leg, a portion of the right side leg and a portion of the left side leg are held above a support surface and the net orientation changes from the angle different from vertical or substantially vertical to an angle that is vertical or substantially vertical.

13. The basketball backstop assembly of claim 12, wherein the first riser is a right leg extender removably attachable to the right side leg, and wherein the second riser is a left leg extender removably attachable to the left side leg.

14. The basketball backstop assembly of claim 1, wherein the right vertical rod and the left vertical rod are formed of fiberglass.

15. The basketball backstop assembly of claim 1, further comprising a first stake adapted for securing the right side leg to a ground surface, and a second stake adapted for securing the left side leg to a ground surface.

16. The basketball backstop assembly of claim 1, wherein the at least one left sleeve comprises a plurality of left sleeves, and the at least one right sleeve comprises a plurality of right sleeves.

17. The basketball backstop assembly of claim 1, wherein upon assembling the assembly, the assembly is freestanding without support connections to a basketball backboard or a post supporting the basketball backboard.

* * * * *